US011953289B2

(12) United States Patent
Angers, Jr.

(10) Patent No.: US 11,953,289 B2
(45) Date of Patent: Apr. 9, 2024

(54) ADJUSTABLE, PIVOTING GUN STOCK AND METHOD OF USE

(71) Applicant: John W Angers, Jr., Youngsville, LA (US)

(72) Inventor: John W Angers, Jr., Youngsville, LA (US)

( * ) Notice: Subject to any disclaimer, the term of this patent is extended or adjusted under 35 U.S.C. 154(b) by 54 days.

(21) Appl. No.: 17/736,836

(22) Filed: May 4, 2022

(65) Prior Publication Data

US 2023/0168064 A1 Jun. 1, 2023

Related U.S. Application Data

(63) Continuation-in-part of application No. 17/538,550, filed on Nov. 30, 2021, now Pat. No. 11,732,998.

(51) Int. Cl.
*F41C 23/00* (2006.01)
*F41C 23/14* (2006.01)

(52) U.S. Cl.
CPC ..... *F41C 23/14* (2013.01)

(58) Field of Classification Search
CPC ..... F41C 23/04; F41C 23/20; F41C 23/14; F41A 11/04; F41G 1/17
USPC ..... 42/75.03, 73, 71.01, 75.01, 75.1
See application file for complete search history.

(56) References Cited

U.S. PATENT DOCUMENTS 243,553 A * 6/1881 Hape et al. ..... F41C 23/14 42/73
476,246 A * 6/1892 Burgess ..... F41A 9/18 42/74
843,227 A * 2/1907 Munson ..... F41C 23/14 42/73
1,295,688 A * 2/1919 Butler ..... F41A 23/08 42/94
1,468,354 A * 9/1923 Caretto ..... F41C 23/14 42/74
1,480,350 A * 1/1924 Martin ..... F41C 23/14 42/74
1,524,973 A * 2/1925 Hazelton ..... F41A 23/08 248/168
2,436,349 A * 2/1948 Adams ..... F41A 23/08 124/29

(Continued)

OTHER PUBLICATIONS

Internet Article, Best AR-15 Offset Iron Sights [View-Throughs], Printed Nov. 26, 2021, https://www.pewpewtactical.com/best-offset-irons/.

*Primary Examiner* — Michael D David
(74) *Attorney, Agent, or Firm* — JOSEPH T REGARD, LTD PLC

(57) ABSTRACT

An adjustable shoulder rest for a rear stock for a rifle or shotgun, with slidable adjustment features at the butt plate to customize the shoulder to firearm interface, providing diverse adjustment options pursuant to user preference and/or circumstances of use. The present invention further provides a pivotal, slidably-adjustable shoulder rest to facilitate customized position adjustment to the firearms orientation vis-a-vis the operator, including the option to provide a swivel connection for adjustment of the firearm during operation as well as the option of providing haptic feedback to communicate to the user or otherwise facilitate line of sight alignment of the firearm at various angles relative to the longitudinal axis thereof in line with one or more sighting apparatus mounted thereto.

21 Claims, 22 Drawing Sheets

(56) References Cited

U.S. PATENT DOCUMENTS

| | | | | | |
|---|---|---|---|---|---|
| 2,453,394 | A * | 11/1948 | Wittman | F41C 23/14 | 42/74 |
| 2,754,608 | A * | 7/1956 | Stieffel, Jr. | F41C 23/06 | 42/74 |
| 4,300,302 | A * | 11/1981 | Anschutz | F41C 23/14 | 42/73 |
| 4,316,342 | A * | 2/1982 | Griggs | F41C 23/06 | 42/74 |
| 5,194,678 | A | 3/1993 | Kramer | | |
| 5,933,997 | A * | 8/1999 | Barrett | F41C 23/14 | 42/73 |
| 6,698,963 | B1 * | 3/2004 | Parker | B62D 7/20 | 403/130 |
| 6,842,015 | B2 * | 1/2005 | Morimoto | H03K 17/98 | 324/661 |
| 8,215,045 | B2 * | 7/2012 | Mitchell | F41C 23/20 | 42/72 |
| 8,499,483 | B2 | 8/2013 | Quaedpeerds et al. | | |
| 9,562,740 | B1 * | 2/2017 | Korliker | F41C 23/14 | |
| 10,907,931 | B2 * | 2/2021 | Schoenborn | F41C 23/04 | |
| 11,732,998 | B2 * | 8/2023 | Angers, Jr. | F41G 1/17 | 42/73 |
| 2007/0253764 | A1 * | 11/2007 | Clayton | F16C 11/069 | 403/122 |
| 2012/0311907 | A1 * | 12/2012 | Cottle | F41C 23/14 | 42/71.01 |
| 2013/0000175 | A1 * | 1/2013 | Quaedpeerds | F41C 23/20 | 42/73 |
| 2016/0187099 | A1 * | 6/2016 | Cottle | F41C 23/14 | 42/73 |

* cited by examiner

FIG 7
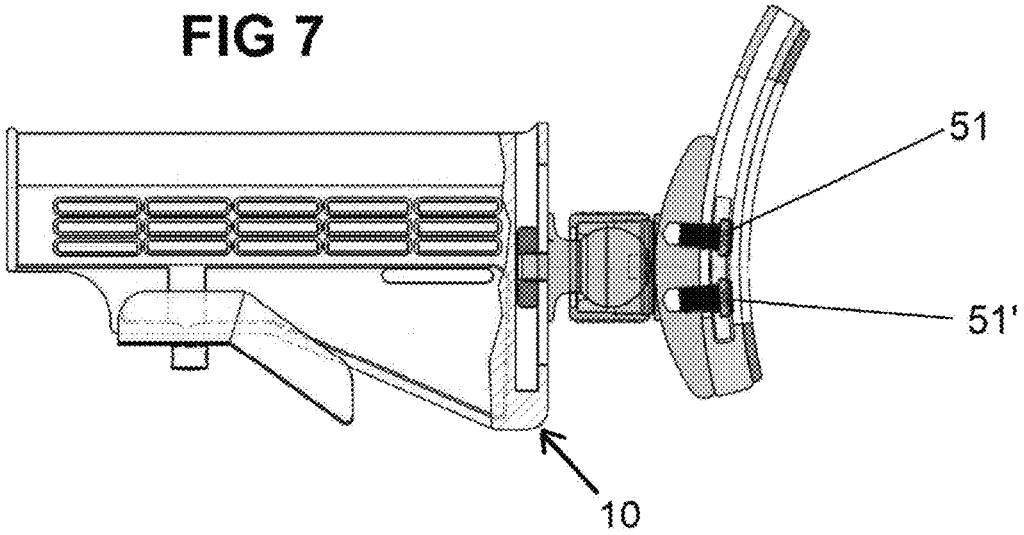
FIG 8
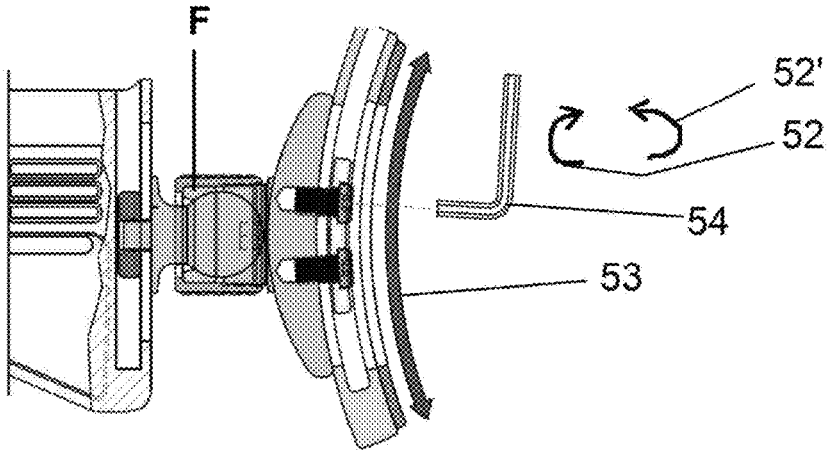
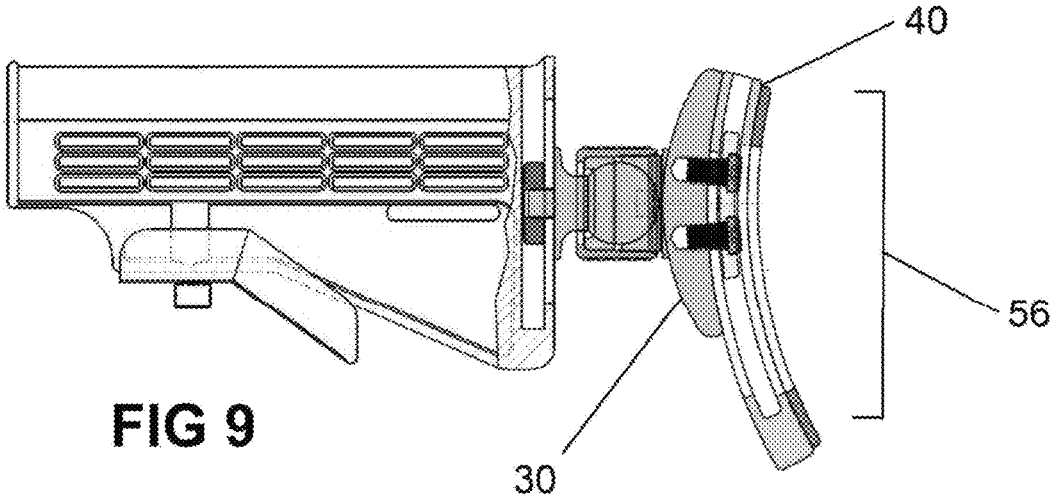
FIG 9

ADJUSTABLE, PIVOTING GUN STOCK AND METHOD OF USE

REFERENCE TO RELATED APPLICATIONS

The present application is a continuation-in-part of U.S. Utility patent application Ser. No. 17/538,550 filed Nov. 30, 2021, listing John W Angers, Jr as inventor, which is incorporated herein in its entirety.

FIELD OF THE INVENTION

The present invention relates to firearms and components therefore, and in particular to an adjustable swivel assembly associated with the butt of a gun such as a rifle or shotgun which can readily provide customizable orientation of the firearm relative to the shoulder of the user, while being easily and quickly re-adjusted depending on user preference and circumstances of use. The present invention provides a pivotal connection to facilitate supported adjustment of the orientation of the firearm via pivoting or rotation which can be locked to a desired position via a swivel lock, a detent system, or haptic feedback system, which can be used to communicate to the user or otherwise facilitate line-of-sight alignment of the firearm at various angles, for example, relative to the longitudinal axis thereof so as to be in line with one or more sighting apparatus mounted thereto, and or to simply provide pivotal support via swivel connection during operation, while maintaining stable engagement to the user.

GENERAL BACKGROUND DISCUSSION OF THE INVENTION

While in use, firearms, and in particular long guns including but not limited to rifles, shotguns and the like, generally rest against a shoulder of the user (typically at an area known as the pocket of the shoulder) to provide support for the weapon and provide a line-of-sight anchor point for aiming as well as absorb any recoil during firing. With most fixed gun stocks, the butt of the stock is placed firmly against the shoulder of the user to provide the anchor point, thus providing a limited available swath of movement of the firearm when in use to maintain line of sight, as the user must reposition the shoulder depending on the location (and the required positioning to maintain line of sight) relative to that user.

Repositioning the firearm for line-of-sight aiming outside of a limited range with a fixed stock without repositioning the anchor point (the user's shoulder) may result in partial or insufficient engagement of the firearm to the user's shoulder, which can increase the amount of recoil force at the point of contact with the user, as well as potentially increasing the possibility of injury or discomfort, and decrease the accuracy of any resulting shot.

Recoil pads or the like provided at the butt or distal end of a fixed rear stock can lessen the shock of the recoil and may provide an increased friction coefficient depending on the material used at the point of contact, but will not eliminate the problem of having to adjust the shoulder commensurate with the line of sight to maintain anchor point between each shot, decreasing accuracy, as well as slowing response time if one is required to reposition one's shoulder and reacquire the target between shots.

Further, if the butt-plate of the firearm is not fully seated against the shoulder of the user, rapid repeated firings such as via a semi-automatic or automatic weapon can jar an unstable anchor point at the user's shoulder and possibly force repositioning of the butt-plate vis a vis the shoulder, resulting in reduced accuracy and control, and increase the possibility of injury.

While various prior patents may contemplate limited aspects related to the present invention, none embody the unique combination wherein the pivotal butt-plate is adjustable to the extent provided, nor the functional configuration of the various components of the present invention to accomplish same.

U.S. Pat. No. 4,316,342 to Griggs issued Feb. 23, 1982 illustrates a device designed to facilitate pivotal repositioning of the rear stock of the firearm relative to the user for recoil dampening/absorption. See also Wittman U.S. Pat. No. 2,543,394 issued Nov. 9, 1948.

Patent 843227 to Munson issued Feb. 5, 1907 and 243553 to Hape et al issued Jun. 28, 1881 illustrate pivoting rear stocks are adjustable to optimize the configuration for the user and circumstances of use.

Patent Application Publication US2013/0000175A1 to Quaedpeerds et al published Jan. 3, 2013 provides a rear stock having an end with recoil pad engaged thereto via ball joint which can be adjustably positioned, so as to facilitate adjustment pad to best engage the shooter in use.

U.S. Pat. No. 8,215,045 teaches a ball and socket assembly used to pivotally mount and secure, via straps or the like, the buttstock of an assault rifle to the shoulder of a user, to stabilize same and maintain position during operation.

SUMMARY DISCUSSION OF THE INVENTION

The present invention provides a uniquely adjustable, pivotable butt-plate adjustably emanating from the rear stock of a rifle or shotgun, which is configured to facilitate optimal engagement to the shoulder of the user, while providing diverse and various adjustment features to fully customize the shoulder to firearm interface, as well as providing the capability for ready re-configuration to accommodate user preference and circumstances of use.

The present invention is particularly suited for competitive shooting, providing a stable, non-moving anchor point for rifles or the like to keep line of sight anchor point consistent through the motions associated with aiming the firearm while maintaining a firm anchor point for line of sight.

In the present invention, the term "firearm" is intended to reference any gun utilizing a shoulder rest, which can include rifles, shotguns, air guns, etc. Also called "long guns", these include any weapon braced against the shoulder when fired. Accordingly, the user of "firearm" or "gun" is not intended to be limiting.

A ball joint built associated with the butt end of the gun stock provides an enhanced anchoring for the rifle to provide an expanded target acquisition area for line-of-sight aiming, while maintaining a stable anchor point at the user's shoulder, and allowing for pivotal readjustment at the anchor point via a pivotal, ball and socket connection. While this is particularly useful in competitive shooting, law enforcement as well as military use, as well as other situations, this system is believed to provide a significant performance enhancement over prior systems.

The original, first embodiment of the present invention utilizes a first slot formed along the butt of the rear stock and having an opening formed along the rear edge of the stock. A second slot emanating from the butt end of the rear stock engages the first slot. The first slot is formed to slidingly receive a ball joint retainer, which has a threaded passage formed therethrough to engage a pivot ball having a base via a threaded portion emanating from said base and passing through a second slot at the end of the stock to engage pivot ball retainer (in the second slot) via its threaded passage, so that the base of the pivot ball rests against the butt end of the rear stock.

An enveloping nut with friction washer and adjustable buttstock connector combination engage the pivot ball to provide a ball and socket-type swivel connection, while allowing the ball to be adjustably situated along the butt end of the buttstock, via the slotted connection.

The cylindrical nut has first and second ends, each forming an opening, and is provided to slide over and partially envelope the ball portion of the pivot ball, as well as receive the friction washer about the neck of the pivot ball to retain same in place. The adjustable buttstock connector has a threaded connector member emanating therefrom formed to engage the inner wall of the nut partially enveloping the pivot ball, providing pivotal engagement while engaging the buttstock connector to the ball portion of the pivot ball.

In use, the present invention allows multiple adjustments as to the position/orientation of the buttstock/butt plate to the shoulder of the user. Further, the pivot ball can be adjusted as to line-of-sight orientation of the firearm relative to the anchor point at the shoulder of the user, and either be adjusted to and fixed in a particular predetermined pivotal orientation such as, for example, via tightening the friction washer via the threaded connection of the adjustable buttstock connector with the nut.

In addition, the present application teaches a second embodiment of the invention which details a haptic feedback or detent feature associated with the ball and socket swivel connection, such via a spring-biased ball bearing emanating from the pivot ball selectively engaging one or more spaced groove(s) or detent(s) in the socket or visa-versa, which can be provided to allow the user to pivot the firearm in real time and receive positional feedback as to the firearm relative to its longitudinal axis.

The detent feature can provide a releasable resistance or locking of the swivel function associated with the pivot ball in the socket at, for example, predetermined line-of-sight alignment points of the firearm, each alignment point associated with a separate sighting device mounted to the firearm, each alignment point which can be associated with a separate sighting device mounted to the firearm, allowing the user to pivot the firearm to select the desired sighting device and receiving positive feedback as to proper alignment with the selected sighting device, all the while maintaining the buttstock securely against the shoulder of the user to maintain a firm anchor point for use. Accordingly, "haptic" references the feature whereby the user is provided physically manifested feedback during operation, in this case, in the form of resistance to further movement when swiveling the firearm with the shoulder rest in place.

This feature of the present invention is particularly suitable for use with a firearm having offset sighting apparatus such as scopes, iron sights, etc, allowing the user to swivel the firearm along its longitudinal axis in a fluid motion while maintaining stable contact with the user's shoulder. The haptic feedback or detent feature can be configured to facilitate feedback such as a point of resistance or engagement during a longitudinal pivot of the firearm where the user's line-of-sight is in alignment with a respective sight(s) on the firearm, allowing the user to pivot the firearm to releasably lock the pivot at each line of sight point for a respective sight on the firearm, allowing for easy, intuitive alignment of the user's line of sight with the chosen sighting apparatus. This is particularly useful for a weapon having one or more mounted offset sighting apparatus in addition to the main sight.

The present thereby provides an easily-implemented, reliable, cost effective, unique and innovative system to customize how the rear stock engages the shoulder of the user during use, while quickly and easily allowing positional of the firearm at the user's shoulder to facilitate re-adjustment to accommodate changes in operating requirements of a firearm and circumstances of use, etc, as well as providing an intuitive means of pivotally adjusting the firearm about its longitudinal axis to provide line-of-sight alignment with a desired sighting apparatus on the firearm, which can include haptic feedback as discussed herein.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein:

FIG. 7 is a side, partial, partially cutaway of the invention of FIGS. 1-6, illustrating the adjustable buttstock shoulder rest engaging the adjustable buttstock connector via first and second fasteners and position lock plate situated at the second end of an adjustment slot formed along the length of said buttstock shoulder rest.

FIG. 8 is a side, partial, partially cutaway of the invention of FIG. 7, illustrating the adjustable buttstock shoulder rest engaging the adjustable buttstock connector via loosened first and second fasteners, and position lock plate situated about medially in said adjustment slot formed along the length of said buttstock shoulder rest.

FIG. 9 is a side, partial, partially cutaway of the invention of FIG. 8, illustrating the adjustable buttstock shoulder rest engaging the adjustable buttstock connector via first and second fasteners, and position lock plate repositioned so as to be situated towards the first end of said adjustment slot formed along the length of said buttstock shoulder rest.

DETAILED DISCUSSION OF THE INVENTION

Figure 1:
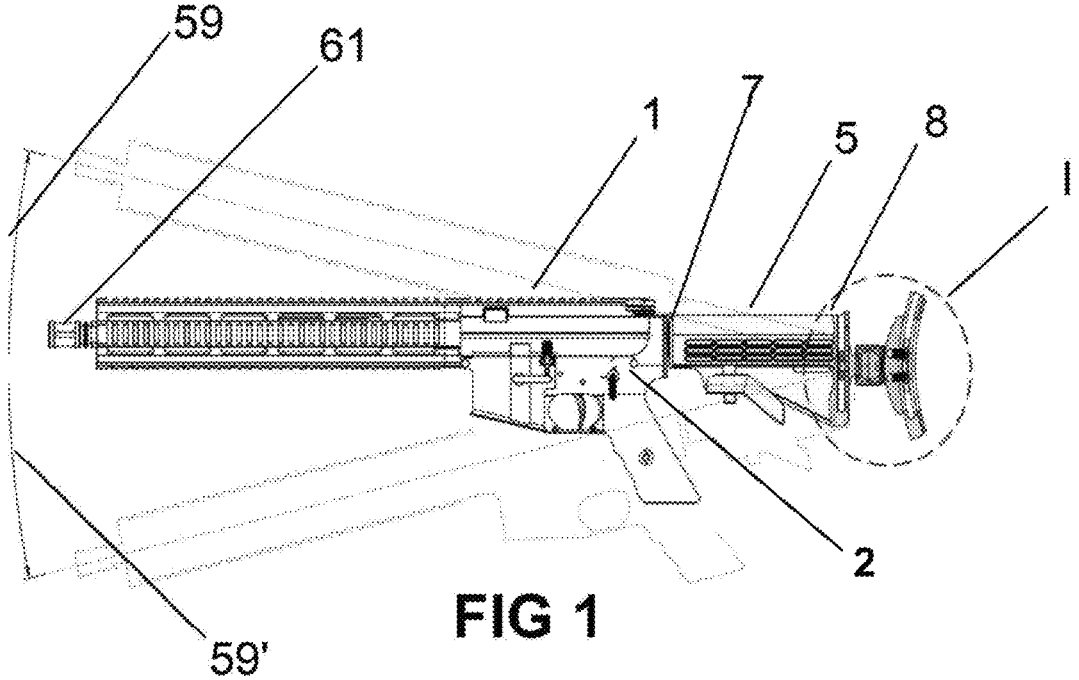
FIG. 1 is a side, partially cutaway view of an exemplary firearm having the apparatus of the first embodiment of the present invention mounted to the butt-end of the rear stock, showing the vertical range of motion afforded by the ball and socket swivel connection, in phantom.
Figure 2:
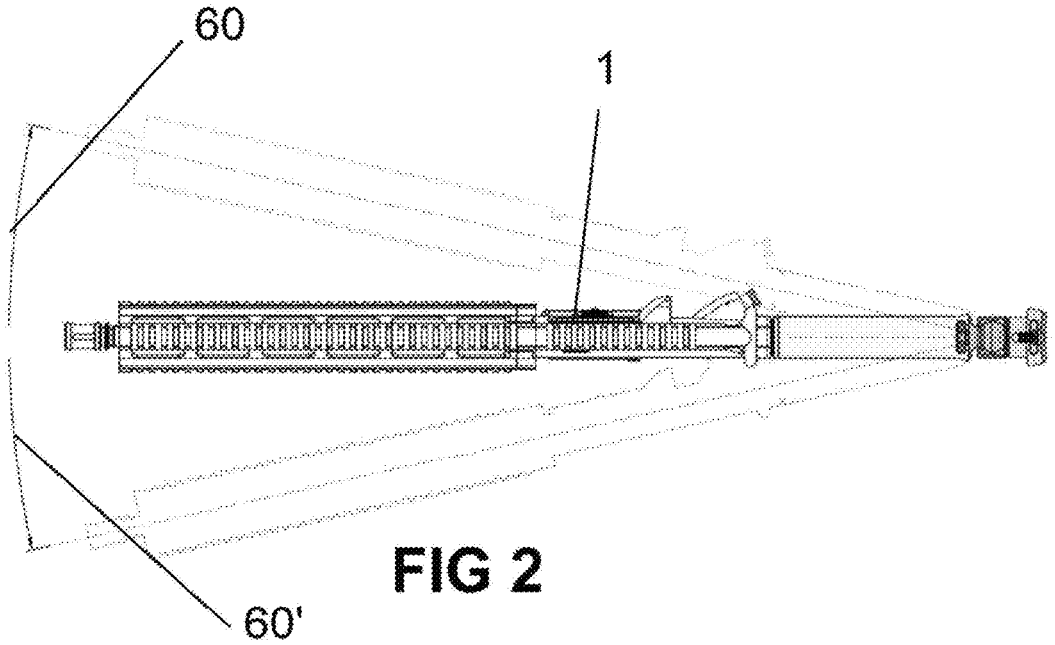
FIG. 2 is a top, partially cutaway view of the invention of FIG. 1, showing the horizontal range of motion afforded by the pivot ball retainer and slot connection forming the ball and socket swivel connection, in phantom.

Referring to FIGS. 1-9, 11-13, and 15, the preferred embodiment I of the present invention emanates from or is mounted to a stock 5 for a firearm 1 having first 6 and second 6' ends, which correspond to the butt 8 and tang 7 of the stock 5, respectively. The butt 8 of the stock 5 further has a first 5' (upper) and second 5" (lower) end corresponding to the heel 9 and toe 9' of the stock, respectively, the tang 7 engaging the receiver 2 of the firearm 1.

Continuing with Figures, situated at the butt 8 end of the stock, either integrally or as an add-on, is a ball-joint carrier 10 assembly comprising a butt plate 10' at its end, the butt plate 10' situated over the length of a first slot 11, which slot is formed in the stock (or add-on applied thereto). The slot 11 is formed to provide an outer access opening 11' near the heel 9 of the butt 8, providing a passage from the first 5' end extending therethrough to about the second 5" end of the butt 8, situated in alignment behind the butt plate 10'. An access opening could also be provided in addition to or alternatively near the toe 9' of the butt 8 of stock 5.

The butt plate 10' at the end of the stock has a formed laterally therethrough a second slot 12 medially 12' situated along its length, and has a length 13 and width 13' dimensioned to allow a threaded shaft to adjustably pass therethrough to access the first slot and slidably adjusted along its length, as will be further discussed herein.

The first slot 11 is formed to slidingly receive a ball joint retainer 14, which has a threaded passage 15 formed therethrough. A pivot ball joint 16 having base 19 with a ball 17 having a top 17" on one end, a neck 18 between the ball 17 portion and the base 19, and a threaded shaft 20 emanating from the base on the other end is provided with the threaded shaft 20 formed to pass through the second slot 12 and engage the pivot ball retainer 14 slidably situated therein via its threaded passage 15, so that the base 19 of the pivot ball joint 16 is slidably adjustable 38 along the length of the butt 8 of the stock or ball joint carrier 10 mounted thereto, depending on whether it (the ball joint carrier) is an add-on, or formed in the stock itself.

After adjusted to the desired position, the ball joint 16 can rotated so as to threadingly engage the threaded passage 15 of ball retainer 14 via hex socket 17' on the top 17" of ball 17 to tighten 39 and retain the ball joint 15 against butt plate 10' to the in the desired position along slot 12.

The ball 17 has an OD 20' formed to receive thereabout a nut 21 having an ID 22 and a length having first 23 and second 23' ends, each end forming an opening, the first end 23 of nut 21 having an inwardly projecting lip 24 around its inner circumference, the second end 23' having taper 25' in the wall thickness narrowing toward said second end 23', the nut formed to slidingly, partially envelope 24' ball 17. Further provided is a threaded area 25 along the ID 22 of the nut 21 at its second end 23'.

Figure 14:
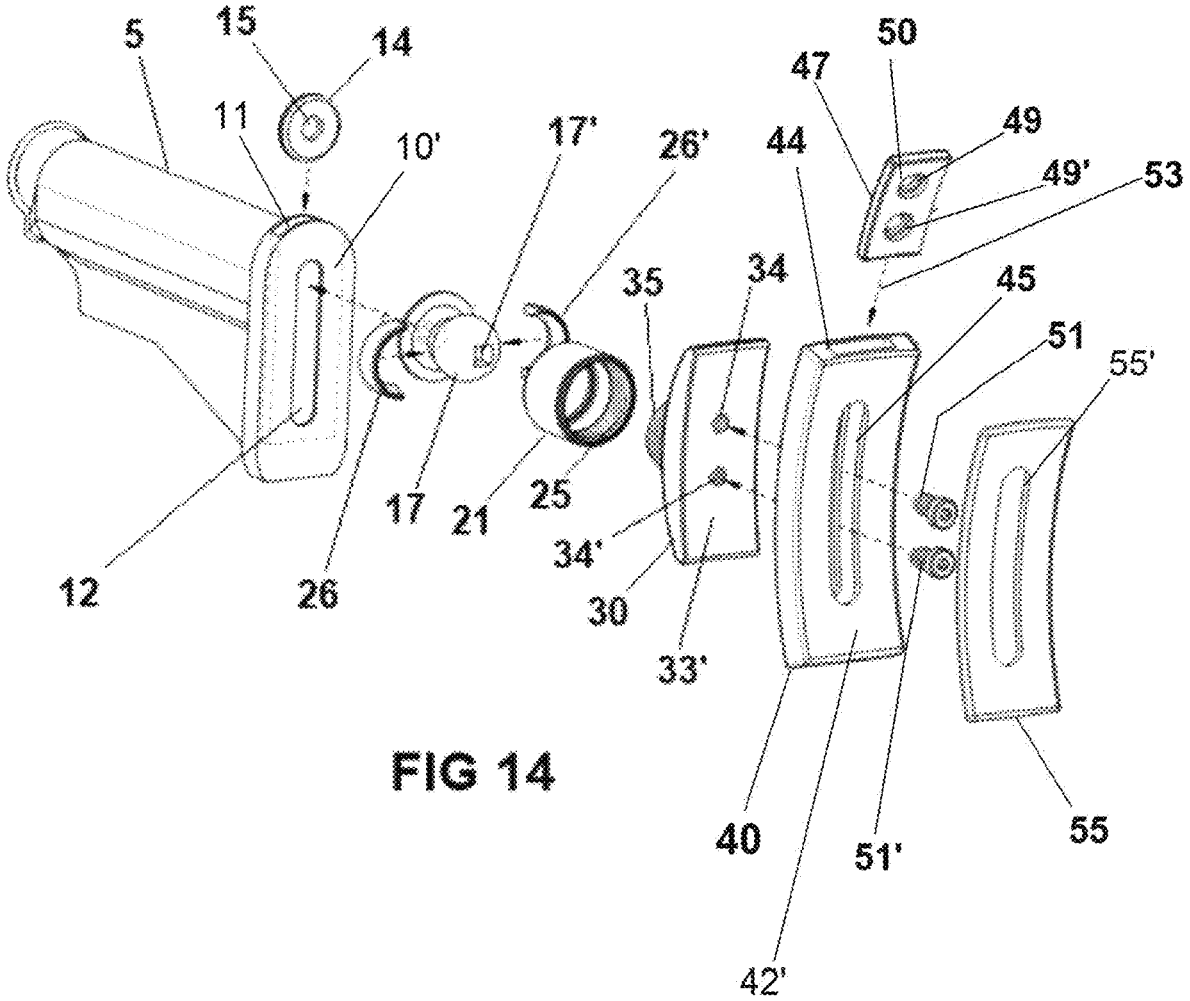
FIG. 14 is a perspective, exploded view of the invention of FIG. 12.

A friction washer F is shown split into two components 26, 26', the washer when assembled having an outer 26" diameter, an inner 27 diameter and first 27' and second 27" open ends, an edge 28 at the first 27' end and an outwardly facing radial taper 28' formed to engage the outer surface of ball 17 at the second 27" end, the friction washer situated about the neck 18 of the ball joint 16 to retain same in place (FIG. 14), with the nut 21 enveloping both the OD 26" of friction washer F,' and ball 17 of ball joint 16, with the edge 28 of friction washer which is split, comprising two components for separation during installation 26, 26' about the neck 16 of ball joint 16, then enveloped and contained by the nut which is slipped over, engaging the lip 24 of nut 21.

An adjustable buttstock connector 30 is provided having first 31 and second 31' ends and a medial area 32' therebetween, and a length 32 being radially curved 33" away from the stock 5, with a front 33 and rear 33' side.

Figure 3:
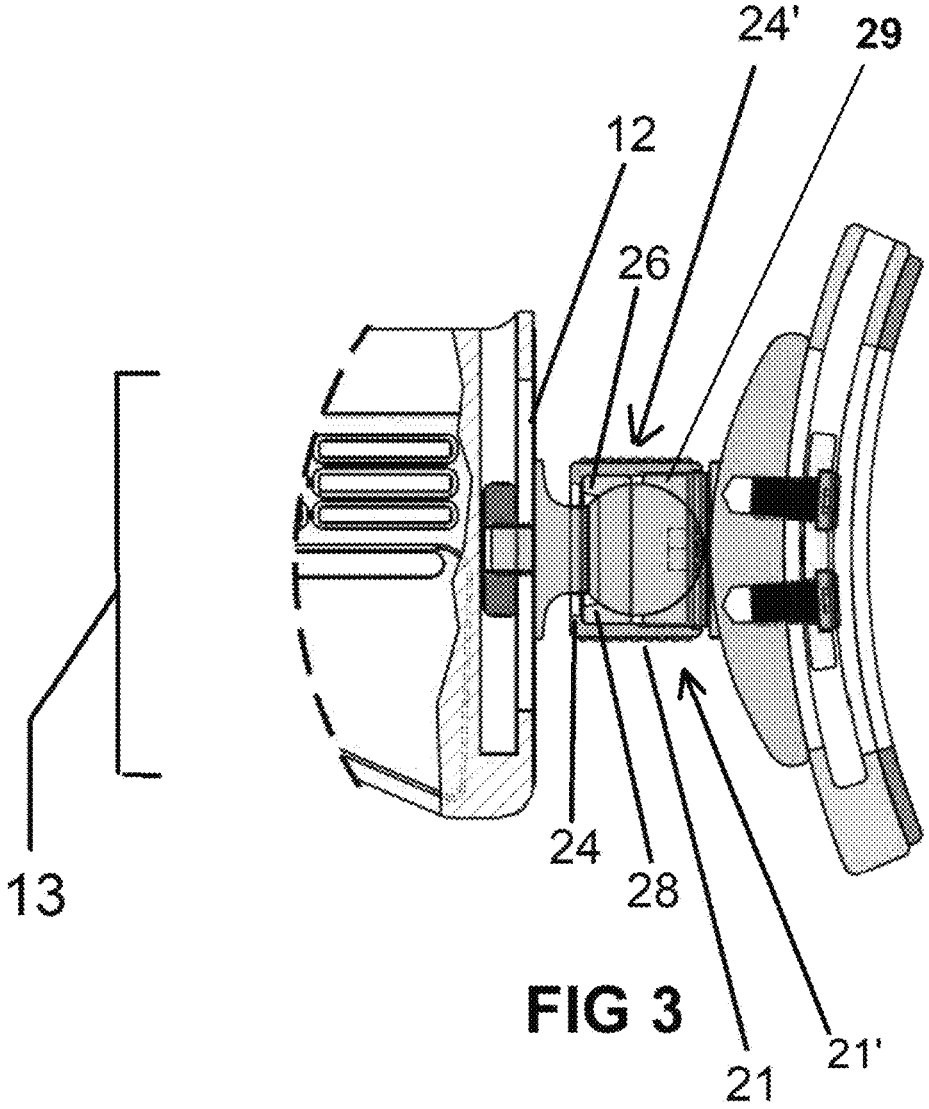
FIG. 3 is an enlarged, partial, cutaway, side view of the preferred embodiment of the apparatus of the present invention, illustrating a close-up of the various adjustable components, ball joint carrier, pivot ball and shoulder rest.
Figure 4:
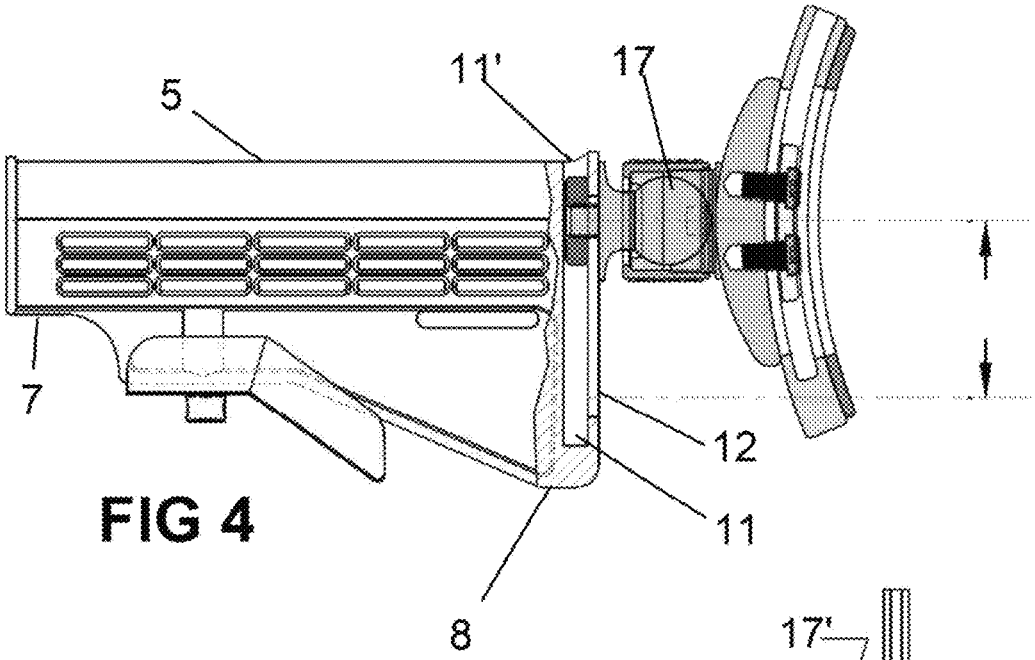
FIG. 4 is a side, partial, partially cutaway view of the invention of FIGS. 1-3, illustrating the device of the present invention mounted to an exemplary rear stock of a firearm, and illustrating the range of adjustment provided by the pivot ball retainer along a slot formed along the ball joint carrier at the butt-end of the rear-stock.
Figure 5:
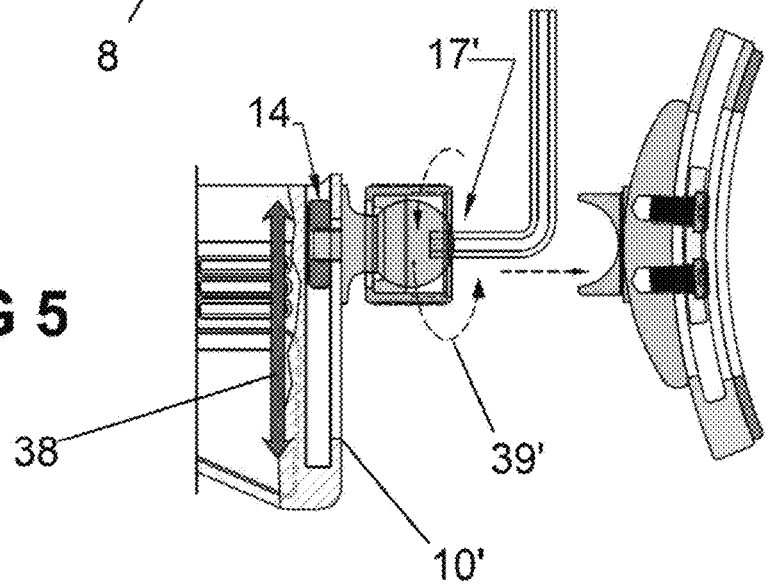
FIG. 5 is a side, partial, partially side cutaway view of the invention of FIG. 4, illustrating the loosening of the pivot ball of said slot to facilitate repositioning of the pivot ball joint retainer from a first end to a second end of said slot.
Figure 6:
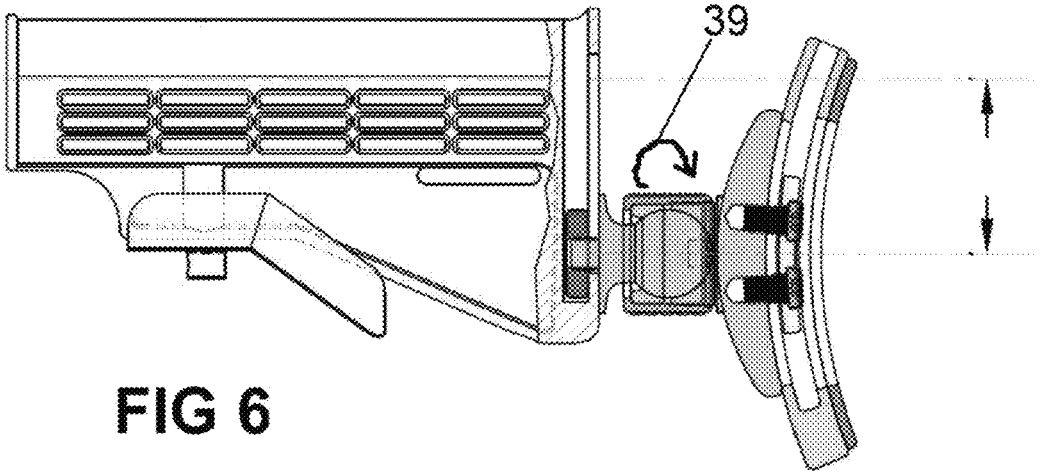
FIG. 6 is a side, partial, partially side cutaway of the invention of FIG. 5, showing the repositioned pivot ball joint retainer at said second end of said slot.
Figure 10:
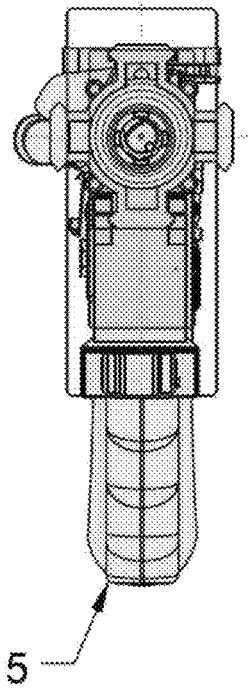
FIG. 10 is a frontal view of the barrel end of the firearm of FIG. 1 as conventionally utilized in the horizontal orientation.
Figure 11:
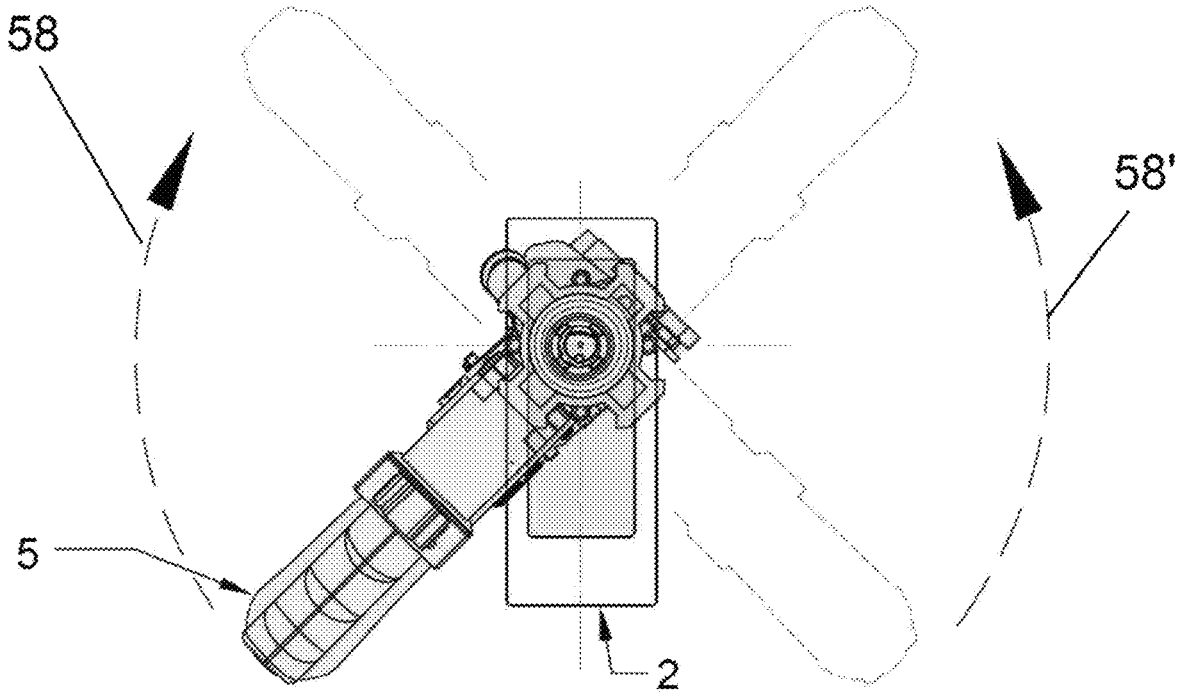
FIG. 11 is a frontal view of the invention of FIG. 1 illustrating an exemplary range of pivot provided by the ball retainer and slot connection forming the ball and socket swivel connection at the rear stock, as shown in FIGS. 1-9.
Figure 12:
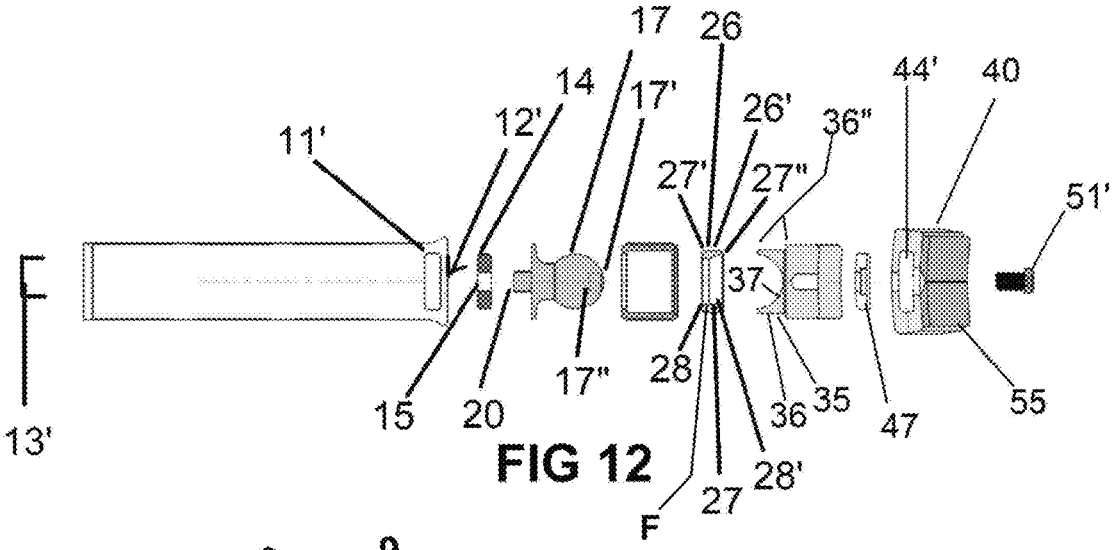
FIG. 12 is a top, exploded view of the invention of FIGS. 3-9.
Figure 13:
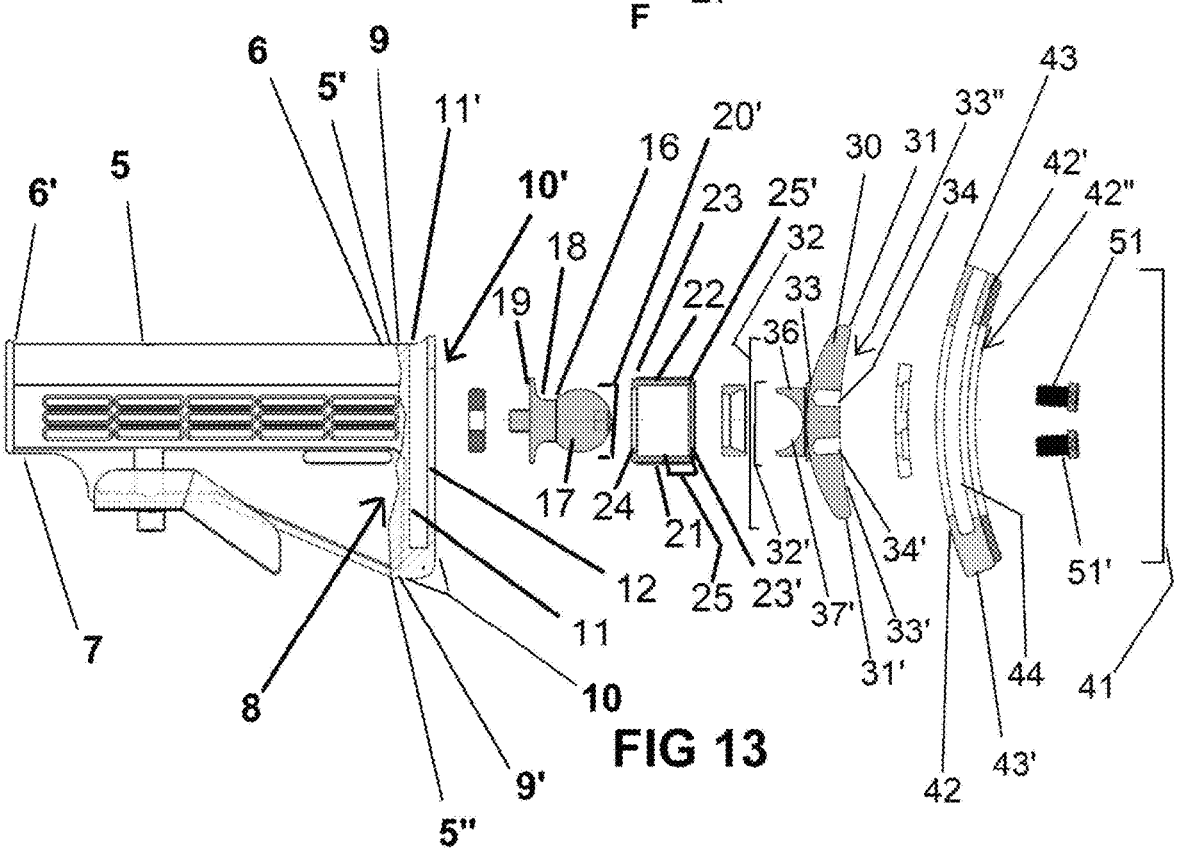
FIG. 13 is a side, exploded view of the invention of FIG. 12.

Emanating from the front 33, medial 32' area is a swivel extension 35 having a length 36" having an outer diameter (OD) 36 which is threaded 36', and a concave socket 37 formed therein having an inner wall 37' provided to engage the outer surface 29 of the top 17' of the ball 17, with the OD 36 formed to engage the threaded 25 inner diameter 25 of the nut 21 when enveloping/engaging the pivot ball (as shown in FIG. 3), providing pivotal engagement 21' (FIG. 3) which can be adjusted to a desired position (or providing a swivel connection) via loosening or tightening the threaded connection between nut 21 and swivel extension 35, the greater tightening the greater resistance to movement. Situated in the medial 32' rear 33' portion of the buttstock connector 30 are two spaced threaded passages 34, 34' for receiving threaded connectors 51, 51', as will be further discussed infra.

The final component in the preferred embodiment of the invention comprises a shoulder rest 40 having a length 41 and opposing first 42 and second 42' sides and first 43 and second 43' ends, the second side 42' formed to receive a relief pad 55 mounted thereto for contacting the shoulder of the user, the shoulder rest further comprising a first slot 44 formed along its length 41 to slidingly 53 receive a position lock plate 47 therein for adjustably mounting the shoulder rest to the buttstock connector 30, the position lock plate 47 formed to receive two fasteners 51, 51' which lengths pass through a second slot 45 formed through the first and second sides of the shoulder rest 40. First and second fasteners 51, 51' engage first 49 and second 49' countersunk 50 passages in the lock plate 47 which is shown slidably positioned in the first slot 44, respectively engaging first 34 and second 34' threaded passages in adjustable buttstock connector, respectively, so that the shoulder rest 40 is positionable (see FIGS. 7-9) vs the buttstock connector 30 via loosening 52 (such as via wrench 54) fasteners 51, 51', and sliding 53 the shoulder rest 40 along its length via the slotted connection with lock plate 47, then tightening 52' fasteners 51, 51' at the desired position 56, such as where the firearm sights are aligned with the user's line of sight to the target.

In use, continuing with FIGS. 1-15, as previously discussed, the present invention I allows multiple adjustments as to the position/orientation of the buttstock/butt plate to the shoulder of the user. The pivot ball can be adjusted so as to facilitate axial orientation 58, 58' of the firearm along its longitudinal axis relative to the user as either fixed in a particular, preferred orientation (via tightening the friction washer via the threaded connection of the adjustable buttstock connector with the nut), as well as providing an active swivel feature to allow the user to pivot the tip 61 of the firearm 1 up 59 or down 59', side 60 to side 60', or axially 58, 58' along its length, or any combination thereof, relative to the user U in real time (by loosening the friction washer at the pivot ball), while maintaining the buttstock securely against the pocket of the shoulder of the user.

The present invention is particularly suited to aid in the competition shooting, hunting, or military use of firearms, providing a stable, non-moving anchor point for the rifle (via shoulder rest 40 engaging the pocket of the shoulder S of the user U to keep line of sight 57 anchor point consistent through motion shooting and twisting of the gun in use in a variety of applications, including but not limited to improving line-of-sight aiming and target acquisition for a fixed stationary as well as moving target, or providing rapid sequential targeting in the case of multiple targets.

The use of one or more rail mounts for firearms for mounting accessories is well known, and can include such diverse configurations as the Picatinny/NATO rail (shown in FIGS. 15-17), or other mounting options such as provided by the Weaver rail, as well as, for example, ARCA, M-LOK/MOE, KEYMOD, dovetail, and other rail configurations. One or more rails can be mounted along the length of the firearm for mounting various accessories such as lasers, flashlights, supports such as bipods or monopods, carrying handles, sling mounts, various sighting options, etc. More than one rail can be mounted at, for example, 90 degrees relative to one another (as shown in the figures) on the firearm as well as other orientations including 45 degrees, for example.

Figure 15:
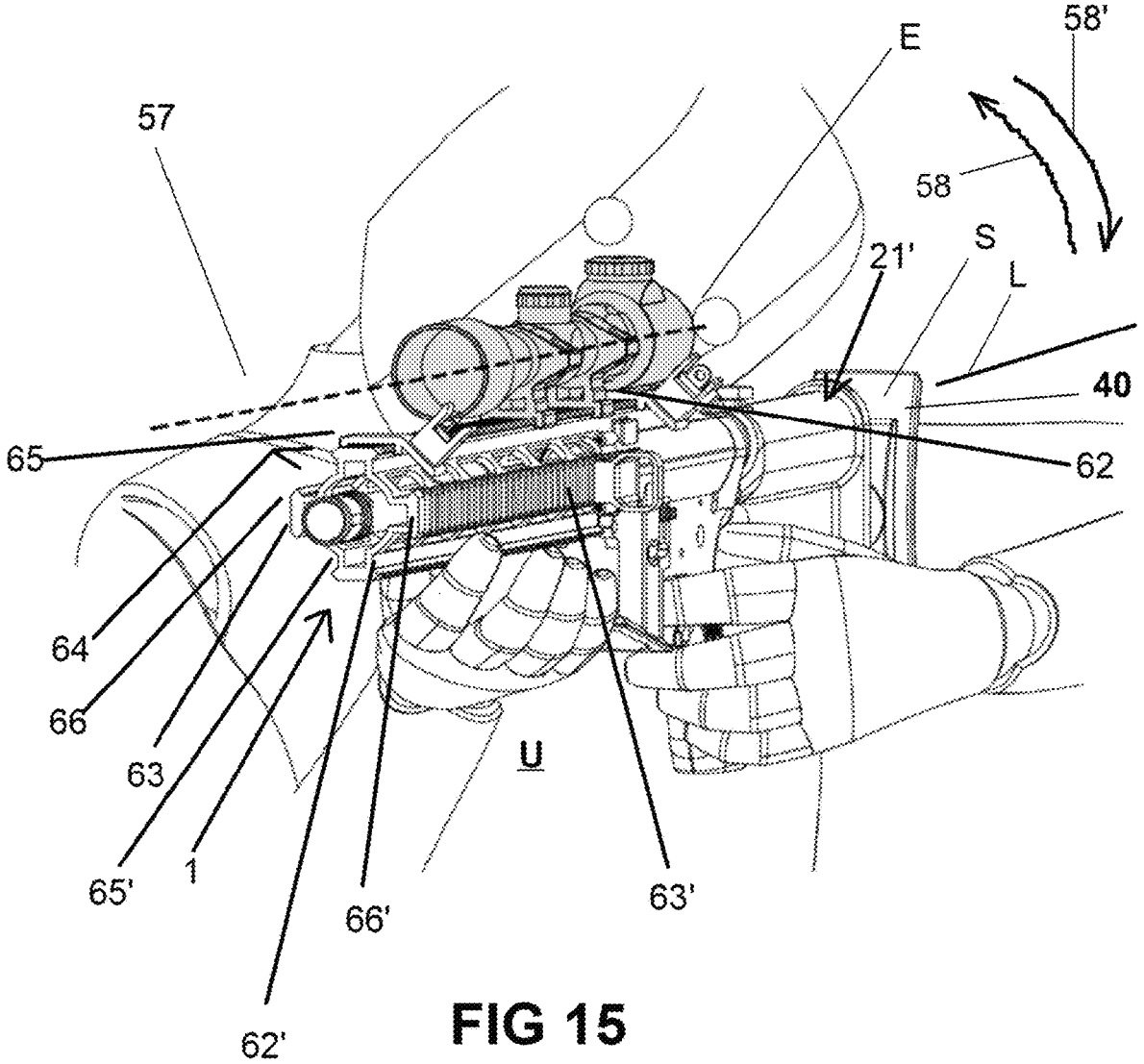
FIG. 15 is a perspective view of a user utilizing the present invention, pivotally adjusting the firearm via the ball and socket swivel at the rear stock to facilitate line of sight aiming through a scope, or telescopic sight.
Figure 16:
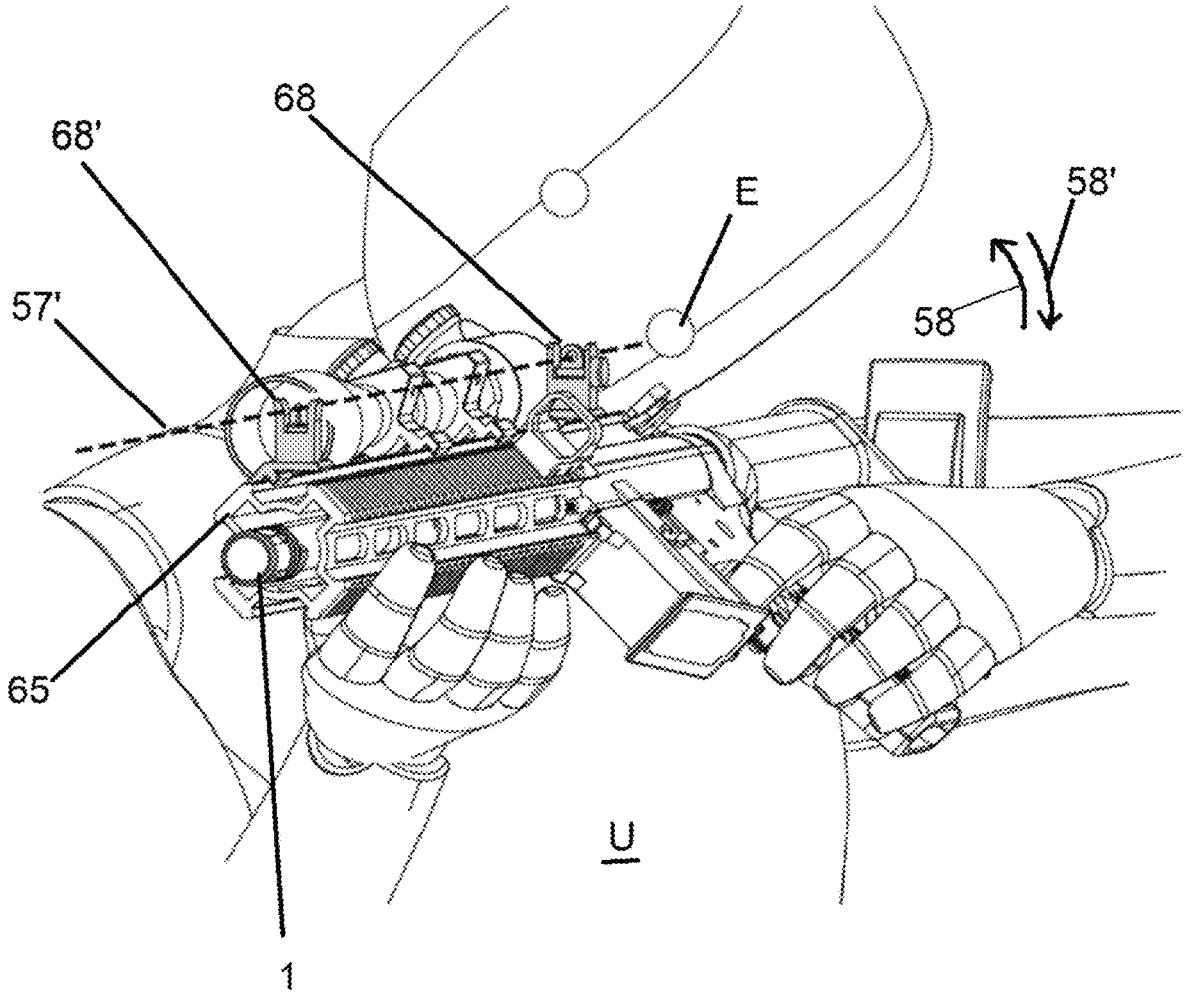
FIG. 16 is a perspective view the present invention in use, illustrating a user utilizing the invention of the present invention by pivotally adjusting the firearm to facilitate line of sight aiming via an iron sight, also known as an open sight.
Figure 17:
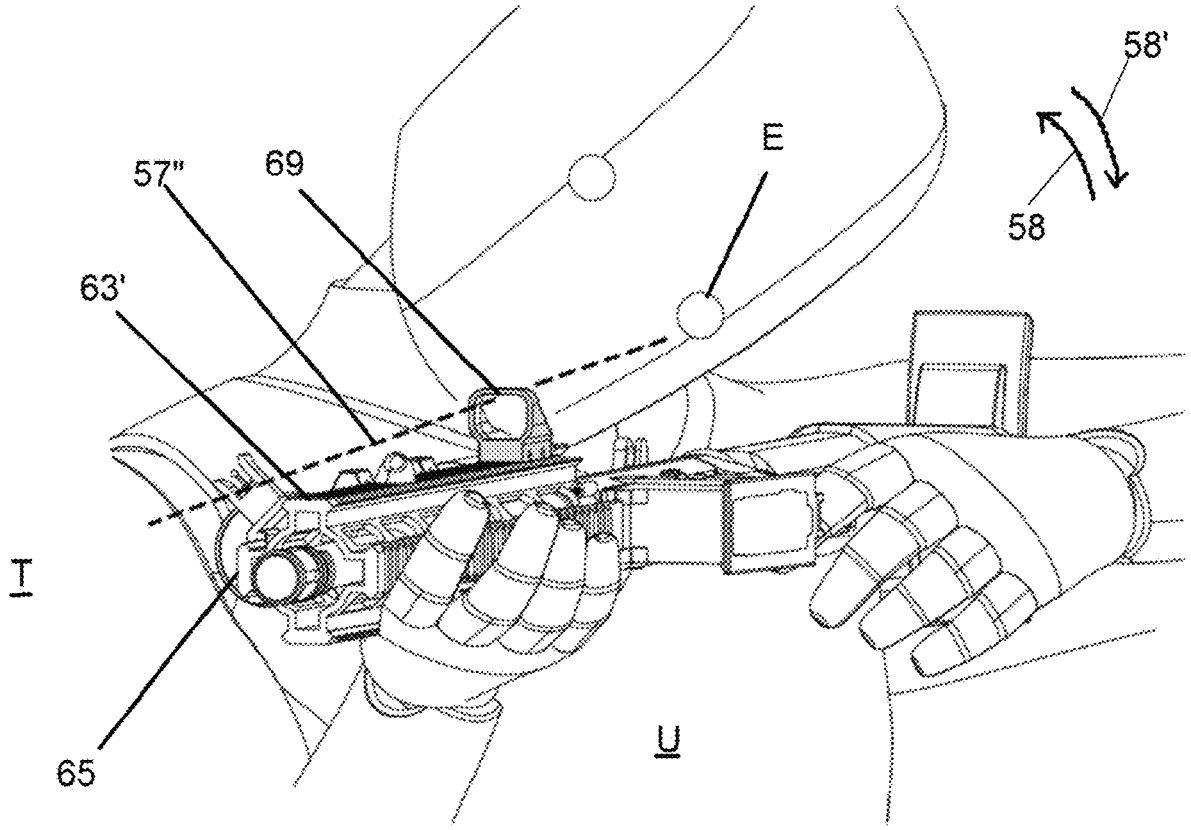
FIG. 17 is a perspective view the present invention in use, illustrating a user utilizing the invention of the present invention by pivotally adjusting the firearm to facilitate line of sight aiming via a reflex sight.
Figure 18:
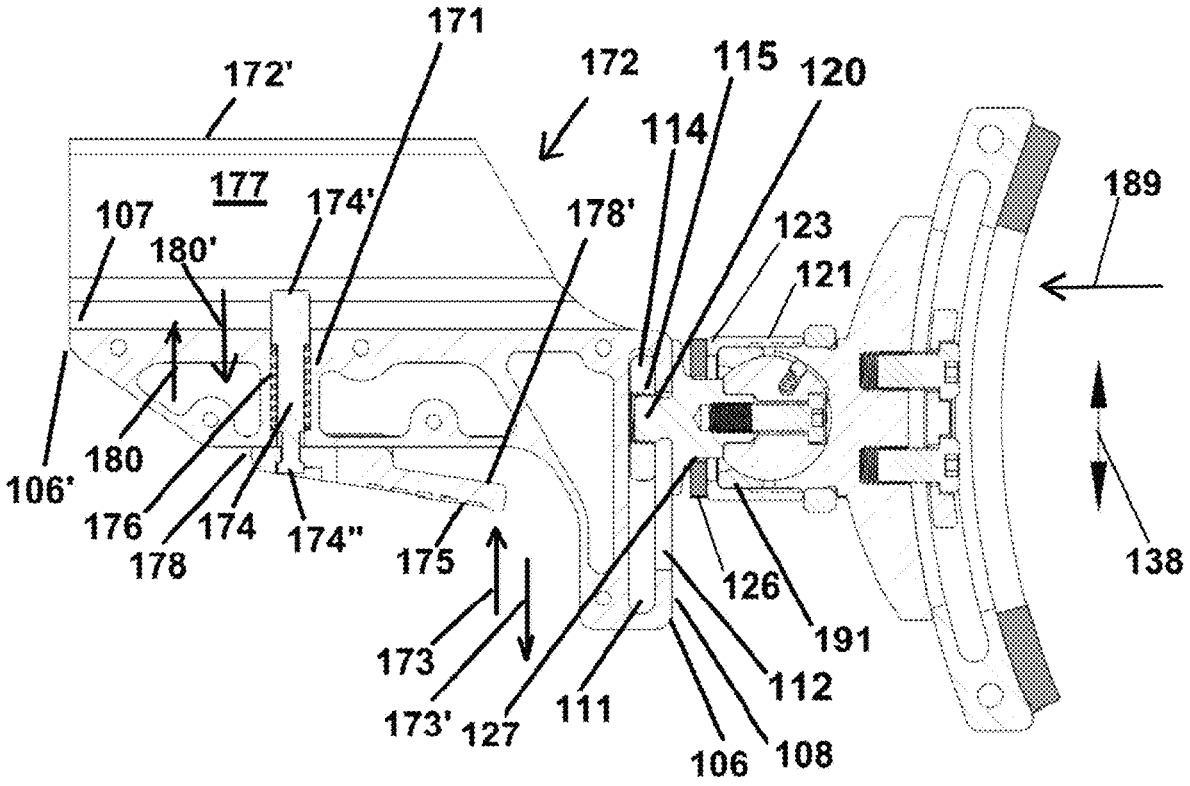
FIG. 18 is a side, partially cutaway view of a second, alternative embodiment of the invention of FIGS. 1-17, the present embodiment shown implemented with a receiver extension-mounted buttstock, the present device illustrating a slot at the end of the butt-stock having a slot formed to slidably receive the threaded base of the swivel ball (with spring biased detent bearing shown), which swivel ball engages an adjustable shoulder rest mounted thereto, the swivel ball base shown mounted at the upper, first end of the slot at the end of the buttstock.
Figure 19:
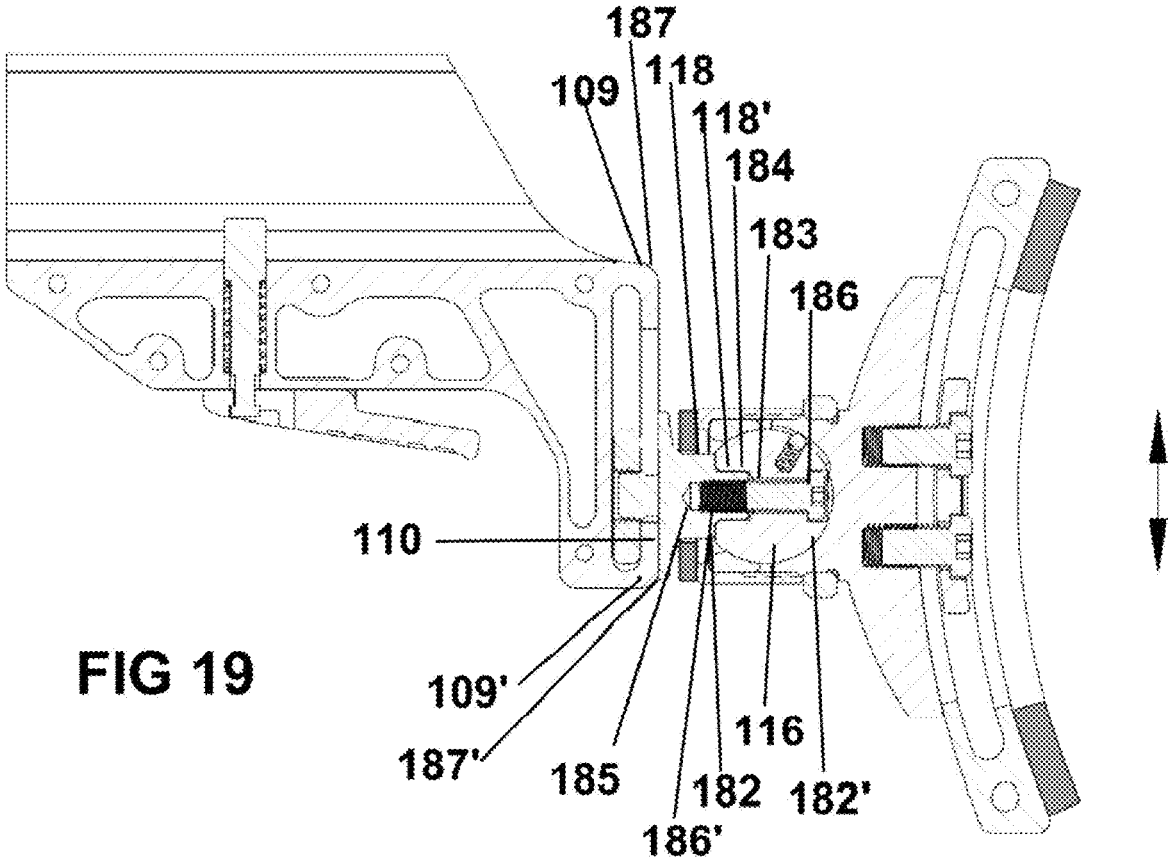
FIG. 19 is a side, partially cutaway view of the invention of FIG. 18, illustrating the split stock of the present embodiment with the swivel ball base shown mounted at the lower, second end of said slot at the end of the buttstock.

Continuing with FIGS. 15-17, the present invention provides an innovative means of accessing on demand a variety of sight options provided on the firearm via the swivel action of the present invention as needed in real time, allowing the user to select and utilize best aiming device taking into account the particular circumstances of use, target being acquired, distance, light conditions, etc.

FIGS. 15-17 illustrate a firearm 1 having top 62, bottom 62', as well as inner 63 and outer 63' side mounting rails situated at 90-degree intervals 64 along the top or upper 65, bottom or lower 65', inner 66, and outer 66' sides of the firearm 1, respectively.

FIG. 15 shows the firearm 1 situated in a horizontal shooting position with the scope situated along the upper 65 rail 62 mounted to the firearm 1. The user U positions the shoulder rest 40 in the pocket S of the shoulder, and (via swivel or pivotal connection 21'), pivots or axially orients 58, 58' the firearm along its longitudinal axis L, while positioning the eye E of the user to align with the scope to provide a line of sight 57 to the target via the scope 62, and aim the firearm accordingly.

FIG. 16 illustrates the option of an iron or open sight comprising rear 68 and front 68' sights, respectively, which are mounted to the top rail 62 of the firearm and positioned to lie at a forty-five-degree angle therefrom on the outer side of the firearm 1. Alternatively, the sight could be mounted directly to the firearm at the forty-five-degree angle via a mount, rail or the like.

In such a configuration, if the user U decides to utilize the iron or open site option, with the shoulder rest 40 in place, the firearm is pivoted to axially orient 58, 58' the firearm to position the eye E of the user in alignment with the rear 68 and front 68 iron or open sights along the line of sight 57' aligned with the target.

FIG. 17 illustrates still another example of use, wherein the option of a reflex sight 69 is provided which is shown mounted to the outer side rail 63' of the firearm, and as such is positioned to be situated along at a ninety-degree angle from on the top 65 of the firearm 1.

In such a configuration, if the user U decides to utilize the reflex site in use, with the shoulder rest 40 in place against the shoulder of the user, the firearm is pivoted to axially orient 58, 58' the firearm to position the eye E of the user in alignment with the reflex site 68 along the line of sight 57", in alignment with the target T.

Accordingly, the present invention allows a user the option of choosing from a variety of aiming options in real time by mounting an aiming option about the firearm as disclosed above, then utilizing the previously disclosed pivotal connection (21' in FIG. 3) to pivot and axially orient the firearm along its longitudinal axis to reposition the firearm to provide line-of-sight access to the desired aiming option by the user while in use.

SWIVEL WITH DETENT FEATURE

Continuing with FIGS. 18-25 and 31, a second, alternative embodiment of Applicant's invention comprises a stock 105 formed by two halves 105', 105" split along its length and joined via fasteners 170, 170', 170" to assemble same, the stock 105 having first 106 and second 106' ends, which correspond to the butt 108 and tang 107 area of the stock 105, respectively.

An extension tube receiver 172 comprising first 172' and second 172" receiver elements is provided along the length of the assembled stock, the tube receiver having an ID 177 formed to slidingly receive and engage the firearm extension tube T, so as to facilitate adjustment of the position of the stock 105 along the length of the extension tube T.

As shown, the extension tube T is selectively adjusted 179 to the desired position along the extension tube receiver 172, and locked in place for use via spring 176 biased adjustment pin 174 having first 174' and second 174" ends. The adjustment pin 174 is formed to slidingly reciprocate in passage 171 formed in stock 105 so as to facilitate disengagement (by retracting adjusting pin 174 from extension tube T) or engagement via spring 176 urging adjustment pin 174 so that its first end 174' engages against extension tube T or into an aperture or cavity formed along the length of extension tube T) via squeezing 173 or releasing 173' pivot lever 175, respectively.

As shown, pivot lever 175 has first 178 and second 178' ends, the first end 178 pivotally engaging the second end 174" of adjustment pin 174 (such as via a self-locking nut and spring pin or the like) so that the spring 176 urges adjustment pin 174 against extension tube T and the first end 178 of pivot lever contacts stock, with the second end 178' of pivot lever 175 is spaced from the stock.

When the second end 178' is squeezed 173 or pressed against stock 105 to overcome the spring 176 bias, the second end 175' of adjustment pin 174 retracts 180 away from extension tube T, allowing adjustment 179 of the stock 105 position extension tube receiver 172 associated therewith along the extension tube T, as long as the first end of pivot lever 175 remains pressed.

Upon completion of adjustment of the stock position along the extension tube T, the first end 178' of pivot lever 175 is released 173' by the user, at which point spring 176 urges 180' the first end 174' of adjustment pin 174 to extend 180' against extension tube, locking the stock in the adjusted position.

The butt 108 of the stock 105 comprises upper 187 and lower 187' ends corresponding to the heel 109 and toe 109' of the stock, respectively.

Situated at the butt 108 end of the stock, either integrally (as shown) or alternatively as a separate add-on, is butt plate 110 (this need not be a separate plate but can be simply the end of the assembled stock as shown in the figs and as shown is formed by joining the two stock halves 105', 105"), forming the end of the stock 105 and at least partially covering an underlying a first slot 111 formed there behind.

The butt plate 110 has formed laterally therethrough a slot 112 medially 112' situated along its length, the slot having a width 113' less than that of underlying first slot 111, the slot 112 dimensioned to allow a threaded shaft 120 to pass therethrough so that its end accesses the first slot 111 to threadingly engage a lock plate 114 with threaded aperture functioning as a ball joint retainer 114 so as to be slidably adjustable along its length, as will be further discussed herein.

In the present embodiment, the ball joint retainer 114 is positioned in the first slot 111 area between the first 105' and second 105" halves forming the stock 105 prior to assembly then joined so that it is provided within the first slot 111 in the assembled stock. The first slot 111 is formed to envelope the ball joint retainer 114, which has a threaded passage 115 formed therethrough and align able with slot 112.

A base 119 for pivot ball 116 is provided which comprises a threaded shaft 120 on one end and a neck 118 with boss 118' emanating therefrom at the other end, the boss 118' formed to engage pivot ball 116 for mounting same, as will be further discussed herein.

The threaded shaft 120 is formed to pass 189 through the slot 112 in butt plate 110 to threadingly engage the pivot ball retainer 114, which is slidably situated in the first slot 111, via threaded passage 115, so that the base 119 of the pivot ball 116 is slidably adjustable 138 along the length of slot 112 via loosening and tightening the threaded connection therebetween using a wrench or the like engage flats 119' on the neck 118 of base 119 and rotating 181 same clockwise or counterclockwise, to tighten or loosen threaded shaft 120 relative to threaded passage 115 in the desired position, respectively.

Continuing with the Figures, pivot ball 116 is shown having first 182 and second 182' opposing ends with a fastener passage 183 formed therebetween, the first 182 end further having formed therein a pocket 184 to receive boss 118' so as to mount pivot ball 116 thereupon. Boss 118' has threaded passage 185 centrally situated along its length therein, positioned to align with pivot ball passage 183 when pivot ball 116 is mounted on boss 118', so that a fastener 186 can pass through ball passage 183 and threadingly engage passage 185 in boss 118' to secure pivot ball 116 in place.

Ball 116 has an OD 120' formed to receive at its first end 182 an insert 191 having a concave ID 191' so as to evenly engage the OD 120' of ball 116 where they contact, the first end 182 of ball 116 with insert 191 being situated in the ID 122 of nut 121 as shown.

Nut 121 has a length having first 123 and second 123' ends, each end forming an opening, the first end 123 of nut 121 having an inwardly projecting lip 124 around its ID 122 to secure insert 191 against ball 116, the second end 123' of nut 121 being threaded 125.

A friction washer 126 is provided having an inner diameter 127 so as to be situated about the neck 118 of the base 119, with the first end 123 of nut 121 situated thereupon so that the friction washer 126 is sandwiched between the base 119 and nut 121. The base 119, friction washer 126, and nut 121 with insert 191 are thereby stacked as shown, and secured via fastener 186 through ball 116, with ball 116 situated in nut 121 to engage insert 191, with ball pocket 184 positioned to receive boss 118', with the fastener 186 engaging threaded passage 185, such that the length of fastener is aligned with the longitudinal axis of the firearm to which the stock is mounted.

Continuing with FIGS. 20-29, an adjustable buttstock connector 130 is provided having first 131 and second 131' ends and a medial area 132' therebetween, and a length 132 preferably being radially curved 133" away from the stock 105, with a front 133 and rear 133'. Emanating from the front 133, medial 132' area of buttstock connector 130 is a swivel extension 135 having a length 136" forming a cylindrical outer diameter (OD) 136 comprising outer threads 136' situated thereabout, the OD 136 encircling a concave cavity forming a socket 137 having therein having a center axis point 128, the socket 137 forming an inner wall 137' dimensioned to evenly engage (where they contact) and partially envelope the outer surface 129 of the second end 182' of ball 116 situated within cavity 137, thereby providing a socket S receive ball 116 and provide a swivel connection therebetween.

The present embodiment has formed in the socket 137 formed to receive a portion of the outer surface of ball 116, one or more indentations, shown in the present exemplary embodiment in the form of grooves 195, 195', 195", 199, 199', each situated along radial lines emanating from the vicinity of the center axis point 128 of the socket 137, each groove shown situated at forty-five degree increments from the adjacent groove, in the present example, zero 203, forty-five 203', and ninety degrees 203", which, for example, would correspond to grooves 195, 199, 199', respectively. In the present example, zero degrees would represent a radial line aligned with the length 141 (FIG. 20) of shoulder rest 140. Each groove has a length 196 having an end 190 in the vicinity of the center point 128 or from an equidistant space from the center point 128, and running to the outer perimeter of cavity.

Each groove 195, 195', 195", 199, 199' has a width 196' and depth 196" forming a radial wall 197 running from edge 198 to edge 198', the radial wall 197 having dimensions formed to evenly engage the outer surface or OD 194' of a ball bearing 194 when in contact. The ball bearing 194 is outwardly biased 200 via helical spring 193 or the like emanating from a shaft 116' formed therein, the shaft 116' having a depth 201 and inner diameter 201' to accommodate the dimensions of the spring and OD 194' of bearing 194, with the spring 193 providing bias 200 to urge bearing 194 away from the shaft 116 and against the socket wall 137' or grooves formed therein, depending on its position.

The placement of the shaft 116' and spring 193 biased bearing 194 on the ball 116 is likewise critical in the present example to ensure proper orientation. In the present example, the shaft with spring and bearing 194 is situated at a zero-degree orientation, to correspond with groove 195 so that its intersection with groove 195 occurs when the firearm is situated in the position shown in FIG. 32, that is, aligned with the sighting device on the top mount.

It is further noted that, although the present example illustrates groove 195 and bearing 194 with shaft being at zero degrees for the above example, this placement is for exemplary purposes only. The bearing and groove can be positioned at other angles relative to the ball and socket, respectively, and provide similar effect, what is important is that the groove and bearing be positioned to intersect and engage such that the shoulder rest and firearm, respectively, are oriented in the desired position.

Figure 20:
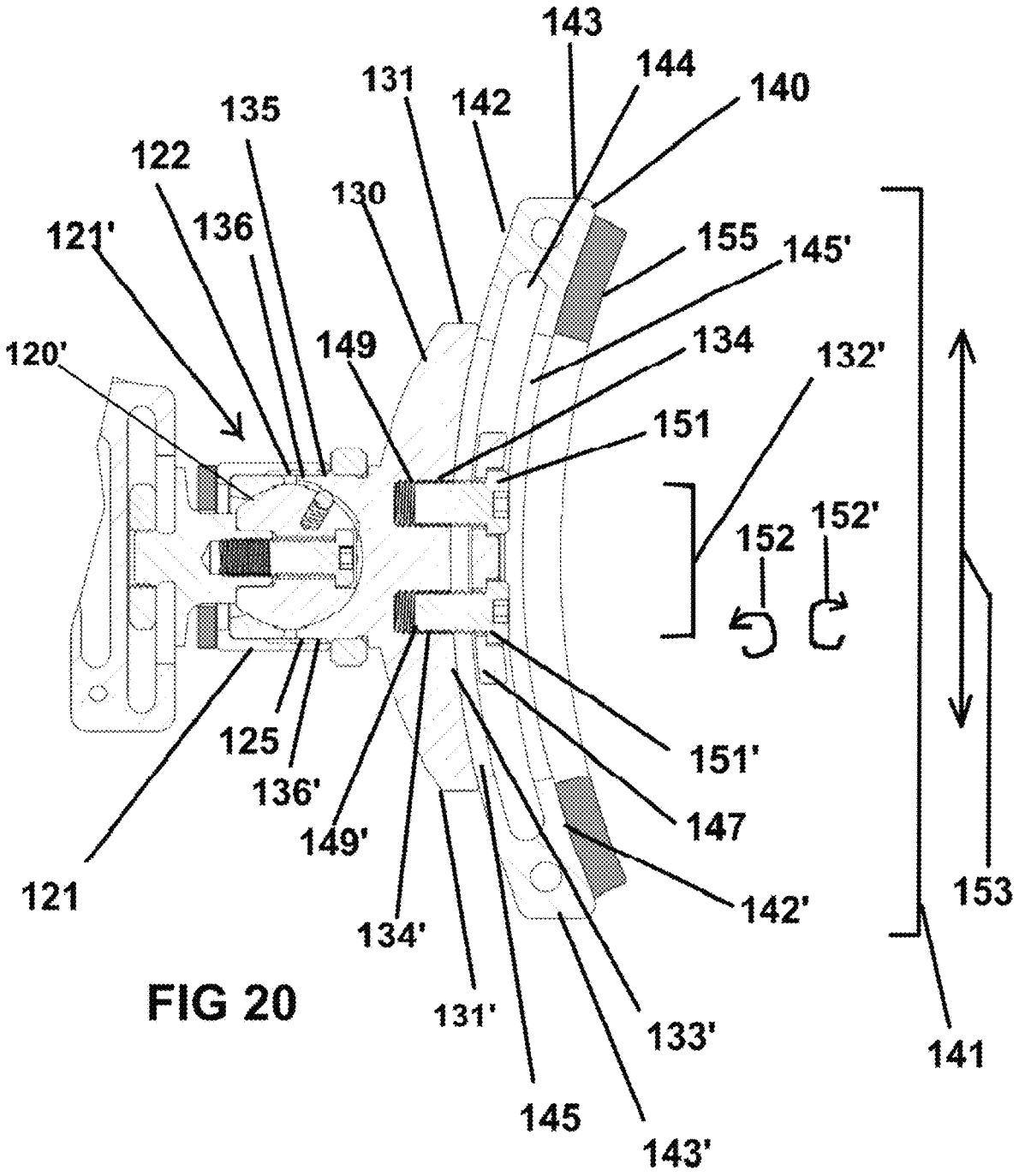
FIG. 20 is a side, partially cutaway view of the invention of FIG. 19, illustrating the pivot or swivel ball base shown mounted about medially along said slot at the end of the buttstock, and the shoulder rest supported via said swivel ball, said shoulder rest mounted via a separate slot which can be adjusted along the slot's length for repositioning same via loosening threaded fasteners to facilitate sliding adjustment along slot, then tightening to lock same in place.
Figure 21:
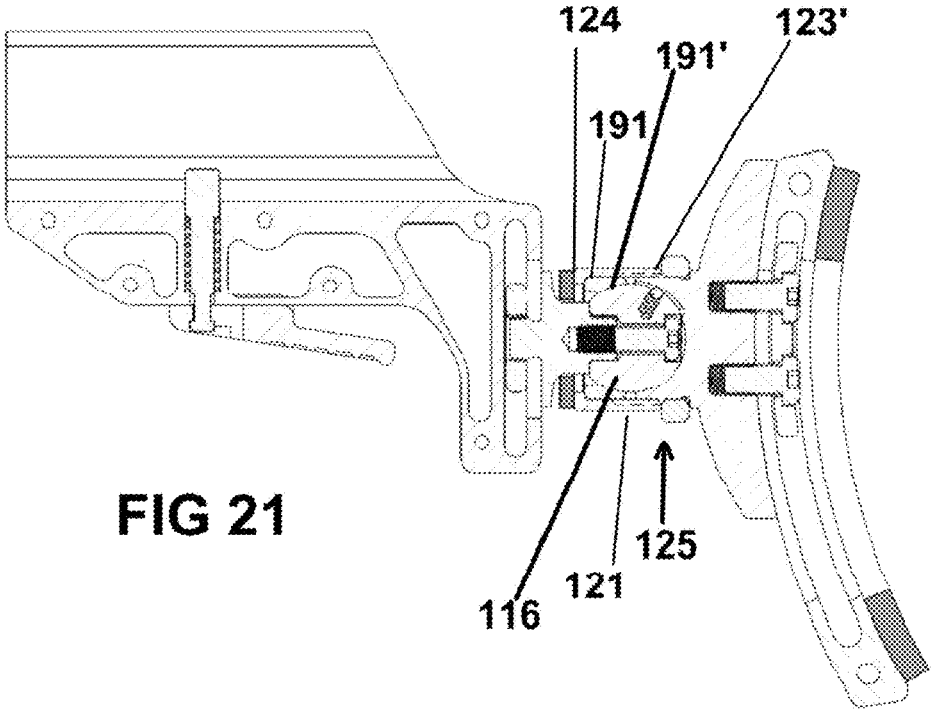
FIG. 21 is a side, partially cutaway view of the invention of FIG. 20, illustrating the swivel ball base shown mounted medially at said slot at the end of the buttstock, and the shoulder rest shown positioned at the medial portion of its mounting slot.
Figure 22:
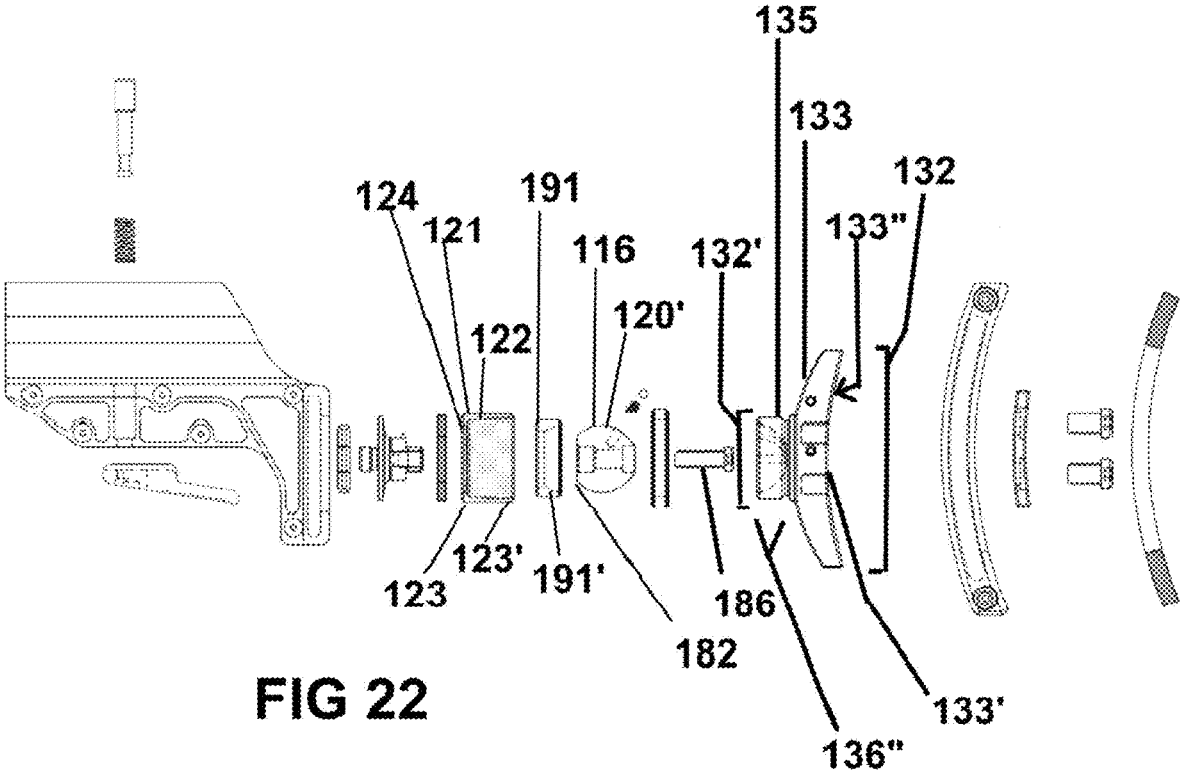
FIG. 22 is a side, partially cutaway, exploded view of the invention of FIG. 21, illustrating the various components forming the present invention, with internal structure shown in phantom.
Figure 23:
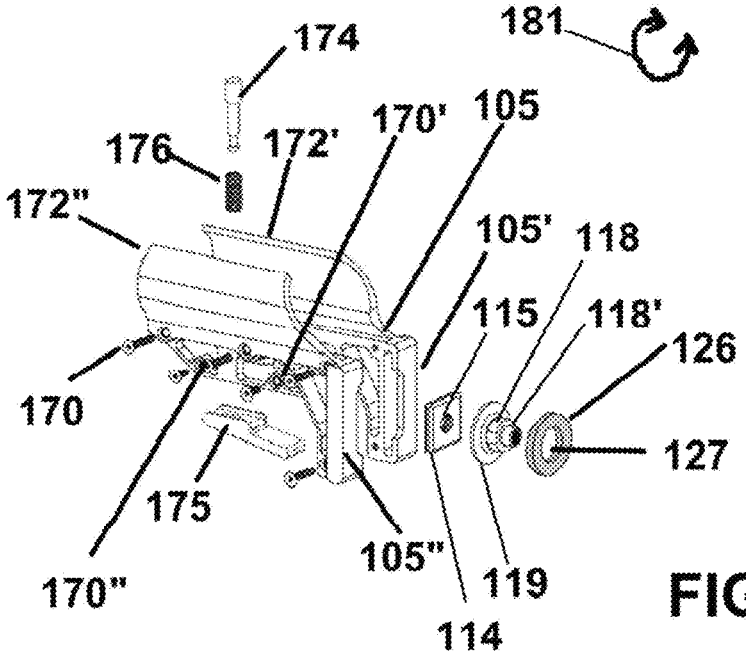
FIG. 23 is a perspective, exploded view of the invention of FIG. 22.
Figure 24:
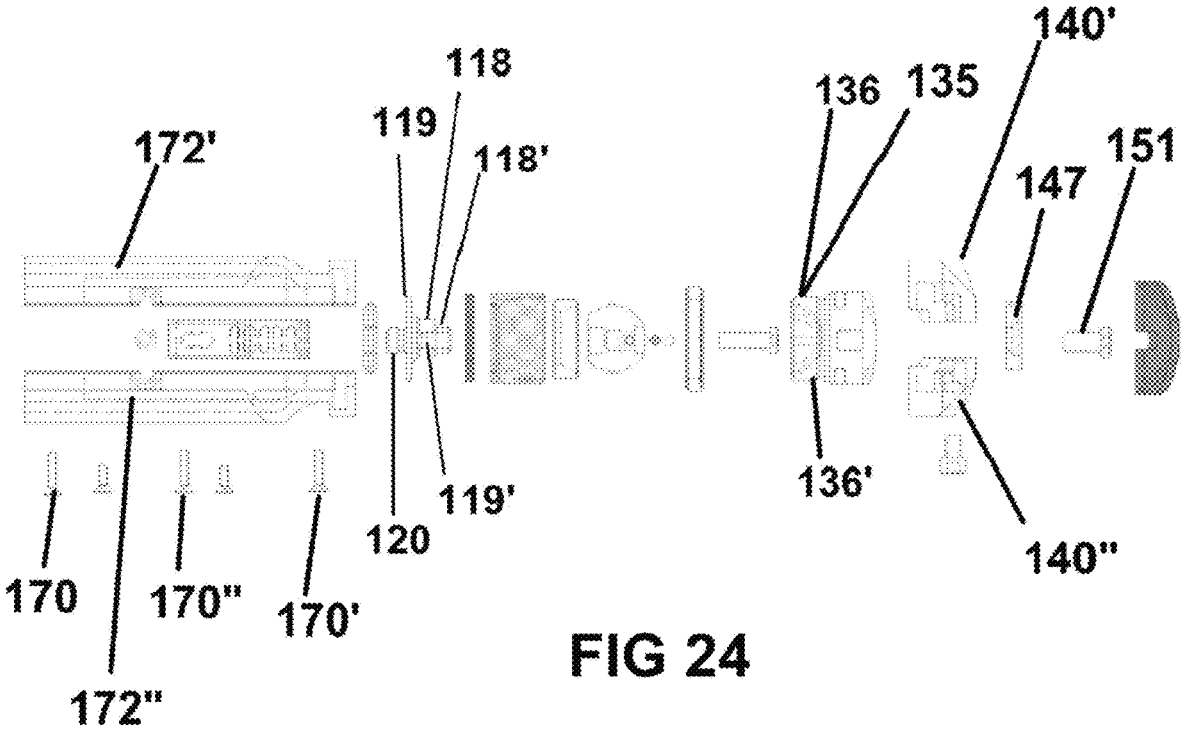
FIG. 24 is a top, exploded view of the invention of FIG. 23.
Figure 25:
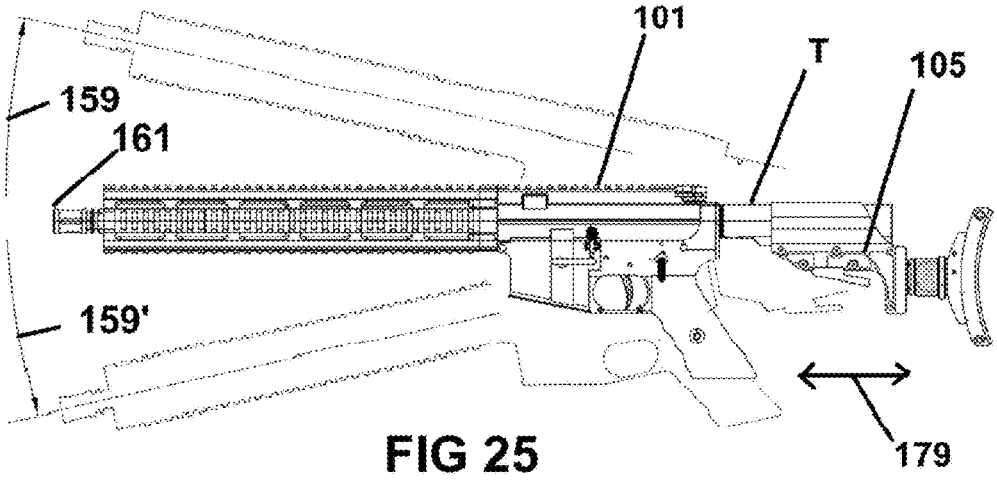
FIG. 25 is a side, partially cutaway view of an exemplary firearm having the apparatus of the invention of FIGS. 18-24 mounted thereto, showing the vertical range of motion afforded by the ball and socket swivel connection, in phantom.
Figure 26:
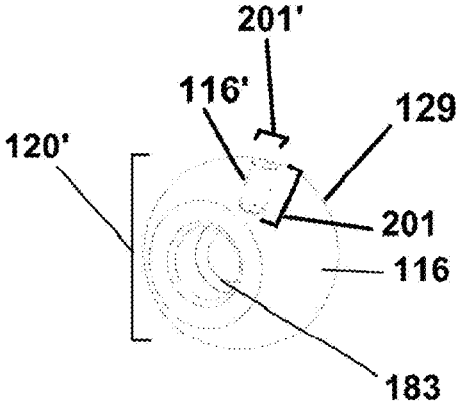
FIG. 26 is a perspective, partial cutaway view of swivel ball of the invention of FIGS. 18-24, illustrating a chamber formed in the swivel ball for receiving a detent spring and ball bearing feature, and fastener passage for mounting said ball to its base, as will be more fully disclosed herein.

Continuing with the Figures, the threaded 136' OD 136 of the swivel extension 135 is formed to engage the threaded 125 inner diameter 122 of nut 121 to secure and envelope/engage the pivot ball (as shown in FIG. 20), facilitating pivotal or swivel engagement and providing a ball and socket swivel or pivotal connection 121' which may be adjusted to a desired position via loosening or tightening the threaded connection between nut 121 and swivel extension 135 increasing or decreasing the tension therein, such that the greater tightening, the greater tension on the ball, increasing resistance. To secure the swivel engagement to a desired tension, lock Nut 202 is provided having an ID 202' to engage the ID of swivel extension 135 and nut 121 to secure the swivel engagement to the desired setting.

In using the present invention, (as will be further discussed herein) repositioning (i.e., via swiveling or pivoting the firearm vs the shoulder rest) of the ball 116 within socket 137 repositions bearing 194 within socket 137.

When bearing 194 encounters a groove formed in socket 137 (for example, groove 195 which is situated at a zero-degree 203 position in socket 137), the spring-loaded bearing provide bias 200 urging bearing 194 against the radial wall 197 of groove 195, engaging same and providing in effect a detent feature while providing feedback in the form of the user encountering a sudden resistance to movement due to the engagement of the bearing 194 with the groove.

This feedback can be used to alert and/or confirm to a user the angular position (as determined by the angle of the groove in socket) associated with the swivel connection of the ball 116 (which is fixedly engaged to the butt 108 of the firearm so this can confirm the angular position of the firearm) relative to the socket S (which is fixedly engaged to the shoulder rest 140), which in the case of groove 195, would indicate a zero-degree 203 position.

Figure 27:
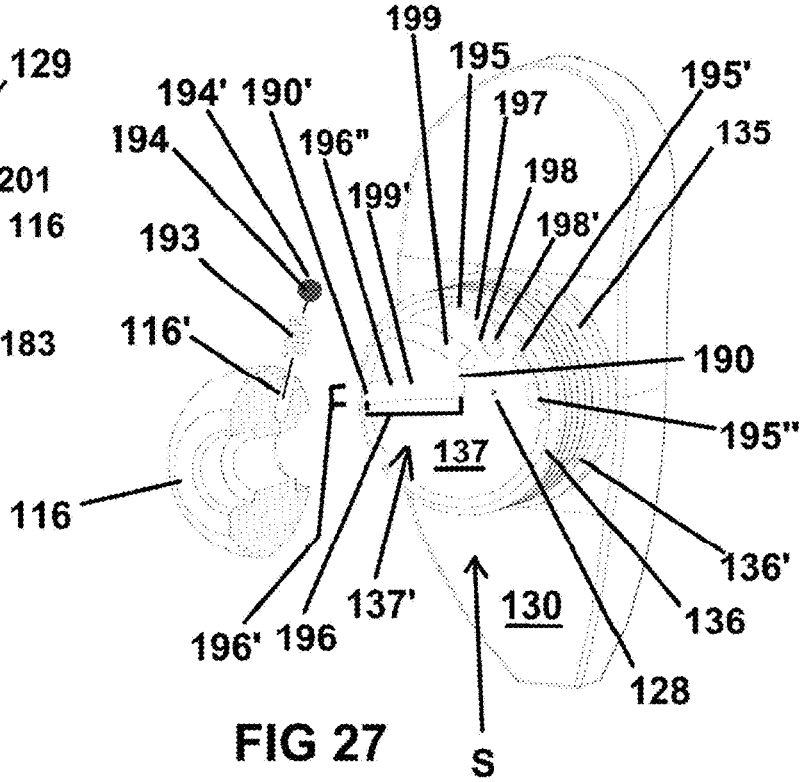
FIG. 27 is a side, partial, cutaway of the swivel ball and socket connection of the invention of FIGS. 18-26, further illustrating the swivel ball positioned for engagement with chamber for receiving a detent spring and ball bearing to provide a spring biased ball bearing formed to selectively engage one or more grooves formed in the swivel ball socket, to aid in proper line-of-sight alignment of offset sights mounted to the firearm.
Figure 28:
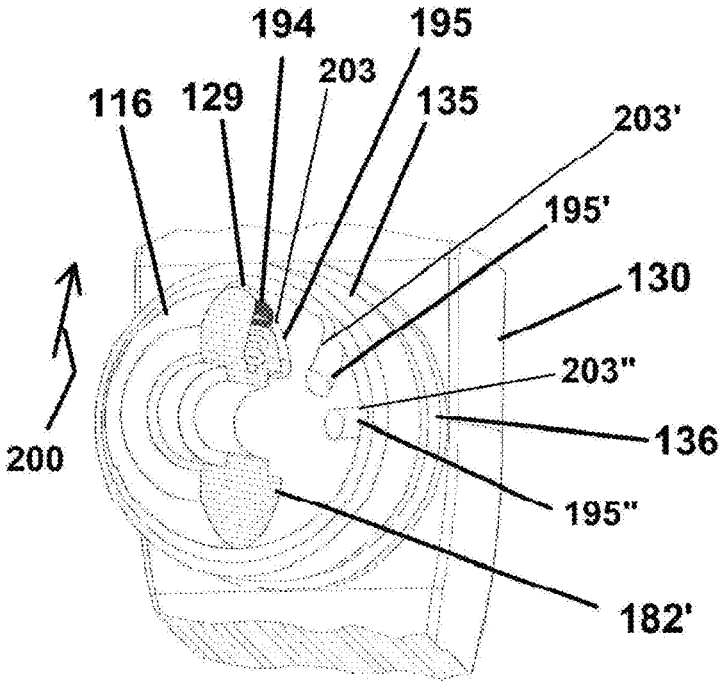
FIG. 28 is a side, partially cutaway, partially cross-sectional view of the invention of FIG. 27, illustrating the swivel ball (in cutaway) in engagement with the swivel ball socket, and spring-biased ball bearing of the swivel ball extended from the bearing shaft to engage a first groove formed therein.
Figure 29:
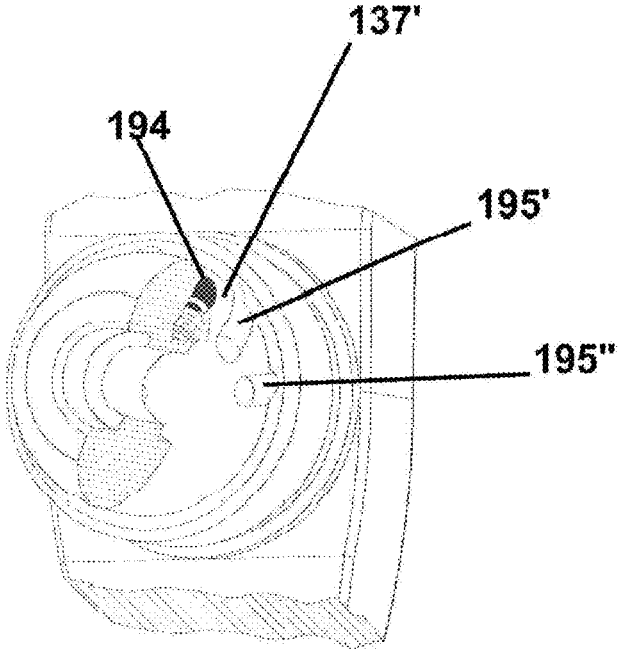
FIG. 29 is a side, partially cutaway, partially cross-sectional view of the invention of FIG. 28, illustrating the biased ball bearing of the swivel ball retracted into the bearing shaft, and situated between the first and second groove formed in the swivel ball socket of FIG. 29.
Figure 30:
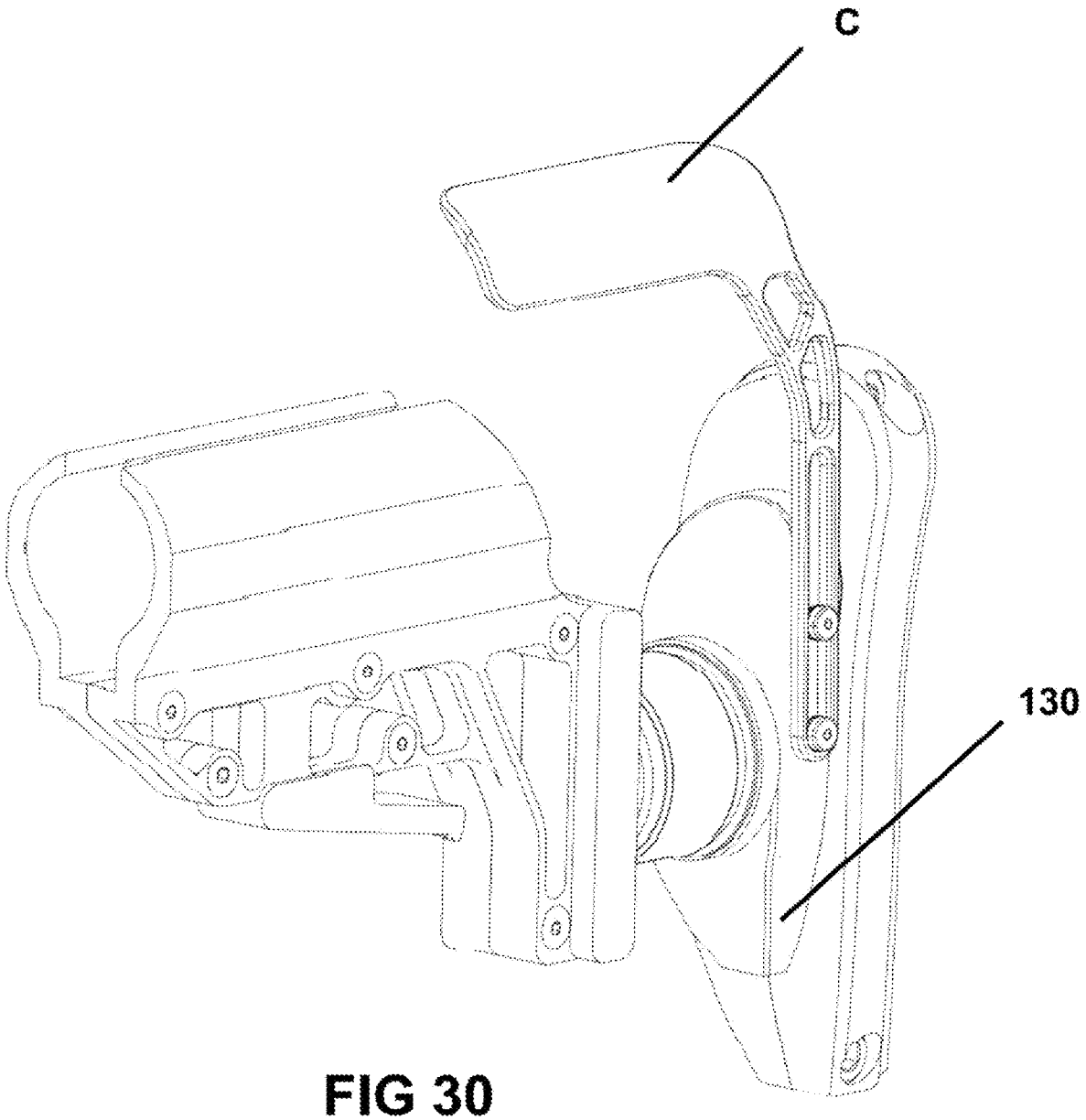
FIG. 30 is a perspective view of the present invention, illustrating a cheek rest feature mounted thereto to provide further stabilization during operation of the firearm.

This can be particularly useful where each groove is situated incrementally relative one another to correlate with a respective mounted sighting apparatus to the firearm, that is, where each groove reflects an angular line-of-sight alignment position with a respective site mounted to the firearm (in this case, in 45-degree increments), as shown the example illustrated in FIGS. 32-34 taking into account FIGS. 27-29, and as will be discussed further herein.

Continuing with the shoulder rest area of the stock, situated in the medial 132' rear 133' portion of the buttstock connector 130 are two spaced threaded passages 134, 134' for receiving threaded connectors 151, 151', respectively, for mounting the shoulder rest to the buttstock connector, as will be further discussed infra.

The shoulder rest 140 has a length 141 and opposing first 142 and second 142' sides and first 143 and second 143' ends, the second side 142' formed to receive a relief pad 155 mounted thereto for contacting the shoulder of the user, the shoulder rest formed of two components 140', 140" split along their length and joined via a fastener or the like to provide the shoulder rest 140 as single unit, the shoulder rest having a first slot 144 formed along its length 141 to slidingly 152 receive a position lock plate 147 therein for adjustably mounting the shoulder rest to the buttstock connector 130, the position lock plate 147 having first and second passages to receive first and second fasteners 151, 151', respectively, each fastener having threaded lengths to pass through second slot 145, 145' formed through the first 142 and second 142' sides of the shoulder rest 140, respectively.

First and second fasteners 151, 151' engage first 149 and second 149' countersunk passages in the lock plate 147 which is shown slidably positioned in the first slot 144, respectively engaging first 134 and second 134' threaded passages in adjustable buttstock connector, respectively, so that the shoulder rest 140 is position able vs the buttstock connector 130 via loosening 152 (such as via allen wrench or the like) fasteners 151, 151', and sliding 153 the shoulder rest 140 along its length via the slotted connection with lock plate 147, then tightening 152' fasteners 151, 151' at the desired position.

In use, continuing with FIGS. 26-29 and 32-34, the shoulder rest, being situated against the shoulder of the user, is in a relatively static position. In the present invention, with the ball and socket connection between the shoulder rest and the buttstock, the user will pivot the firearm while the shoulder rest remains relatively static in position during use.

The present invention utilizes this characteristic to provide a detent feature whereby the spring-biased bearing in the ball, forming the first component of the detent feature, is formed to engage the groove(s) formed in the socket, forming the second component in the detent feature, to provide a form of haptic feedback to alert the user as to the optimal alignment of the one or more sighting devices mounted to the firearm, as those grooves are positioned in relation to the bearing location to correlate with the location of a sighting device mounted to the firearm, or the mount associated therewith.

In such a use, when the user pivots or axially rotates 158, 158' the firearm 101, the ball 116 is likewise repositioned in the socket 137 (as the socket remains basically stationary as it is affixed to the shoulder rest engaging the user). During such movement of the ball 116 within socket 137, the spring 193 biased 200 ball bearing 194 emanating from the pivot ball 116 will engage any groove (for example, groove 195) it encounters during such positioning, providing a releasable resistance of the swivel function at that point of engagement. This point of engagement can be correlated to a predetermined line-of-sight alignment point for the firearm vis a vis the shoulder rest (in the case of ball bearing 195 engaging groove 195 in the present example both being positioned at zero degrees relative the ball 116 and socket 137, respectively, this would position the firearm at zero degrees), each alignment point associated with a sighting device mounted to the firearm.

This allows the user to pivot the firearm relative to the shoulder rest, to select the desired sighting device and receiving positive feedback (via the bearing in the ball engaging the grooves in the socket) as to proper alignment with the selected sighting device, all the while maintaining the buttstock securely against the shoulder of the user to maintain a firm anchor point.

It is noted that, while the present invention illustrates the use of a biased ball bearing emanating from the ball engaging one or more radial grooves in the socket, such an arrangement could be reversed, i.e., a biased ball bearing emanating from a shaft in the socket used to engage one or more properly positioned grooves along the ball, with similar operational characteristics.

The present invention is particularly suited to aid in the competition shooting, hunting, or military use of firearms, providing a stable anchor point for the rifle (via shoulder rest 140 engaging the pocket of the shoulder S of the user U) to maintain line of sight 157 anchor point consistent through motion shooting and twisting of the gun in use in a variety of applications, including but not limited to improving line-of-sight aiming and target acquisition on a firearm having more than one sighting device mounted thereto.

As with the first disclosed embodiment, one or more rail mounts (shown as top 162, bottom 162', and opposing side 163, 163' mounts) can be mounted along the length of the firearm for mounting various accessories such as lasers, flashlights, supports such as bipods or monopods, carrying handles, sling mounts, various sighting options, etc. More than one rail can be mounted at, for example, 90 degrees relative to one another (as shown in the figures) on the firearm as well as other orientations including 45 degrees, for example.

Continuing with the figures, a firearm 101 is provided having top 162, bottom 162', as well as inner 163 and outer 163' side mounting rails situated at 90-degree intervals 164 along the top or upper 165, bottom or lower 165', inner 166, and outer 166' sides of the firearm 101, respectively.

Figure 32:
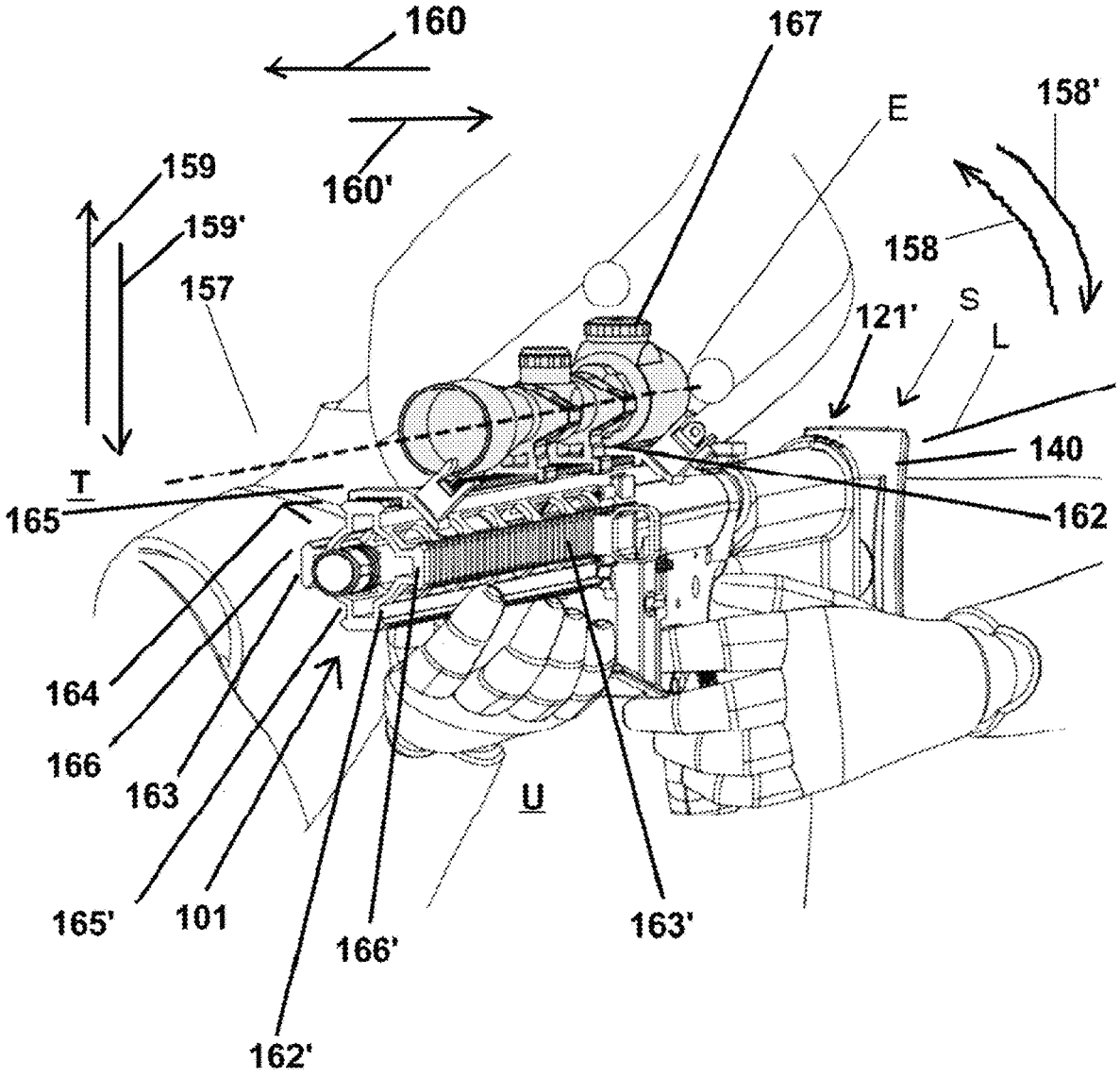
FIG. 32 is a perspective view of an exemplary user utilizing the second embodiment of the present invention, pivotally adjusting the firearm via the ball and socket swivel at the rear stock to facilitate line of sight aiming through a scope, or telescopic sight, situated along the top mount of the firearm.

FIG. 32 shows the firearm 101 situated in a horizontal shooting position with the scope situated along the upper 165 rail 162 mounted to the firearm 101. In use, continuing with FIGS. 32 and 29, the user U positions the shoulder rest 140 in the pocket of the shoulder, and pivots or axially orients 158, 158' (utilizing the swivel connection 121' provided via ball 116 and socket 137) the firearm along its longitudinal axis L. This repositions ball 116 in socket 137, so that, when the spring-biased ball bearing 184 engages groove 194, the user encounters resistance to further axial movement at zero degrees 203 due to spring biased bearing 194 engaging socket 194 (which is situated at zero degrees 203), placing the scope 167 at zero degrees and providing user with a line of sight 157 to the target via scope 167 and aim the firearm accordingly. It is noted that zero degrees is used only as an example of optimal orientation for line-of-sight and this can vary depending on the user's preferences and position.

It is further noted that, with the bearing and groove intersecting at zero degrees for placement of the firearm as shown in FIG. 32, with the groove situated at zero degrees in alignment with the length of shoulder rest as earlier referenced.

Accordingly, in the present example, if the length of the shoulder rest is situated in a vertical position, and the groove 194 is situated in alignment with the length of shoulder rest at zero degrees, the firearm 101 can be pivoted up 159 or down 159' vertically relative to the shoulder rest, and the bearing 185 will traverse along the length of groove accordingly, while resisting axial motion, which in this example would run lateral to the groove.

Figure 33:
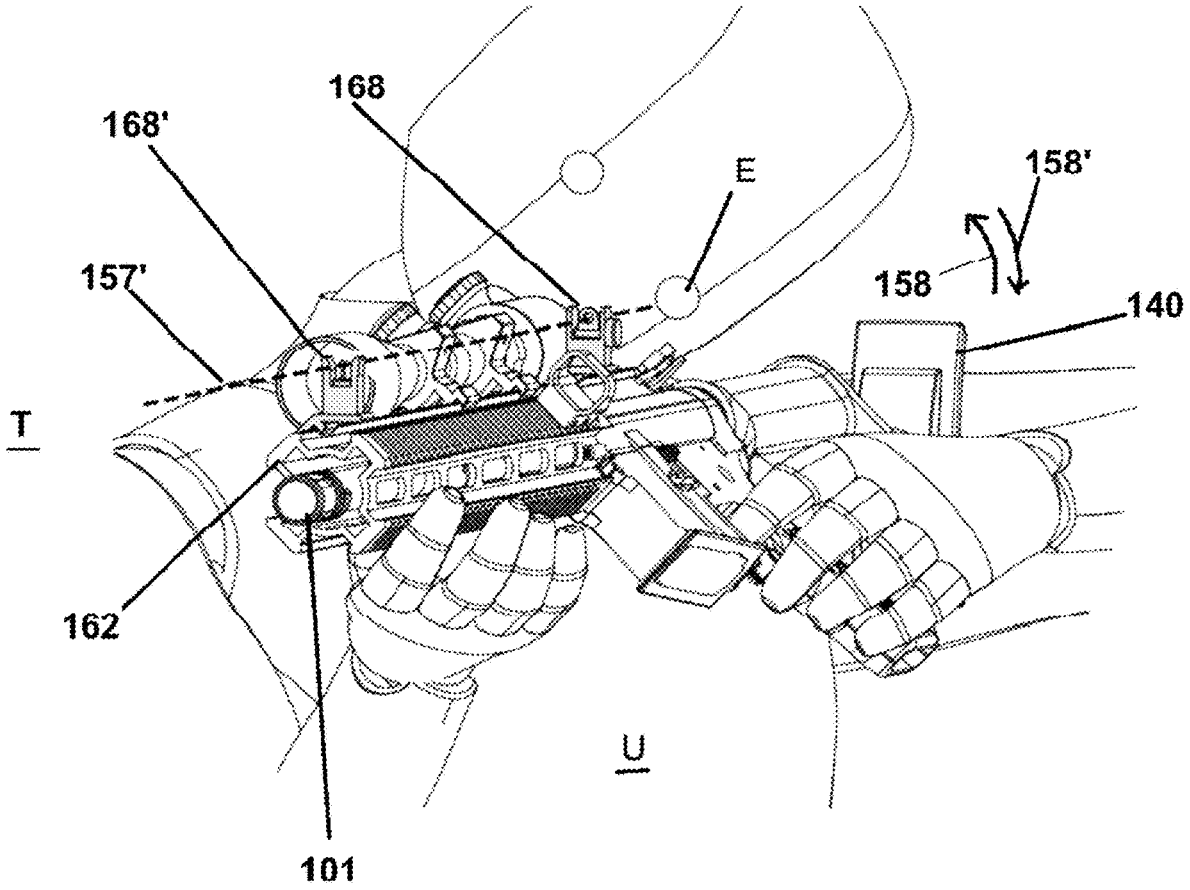
FIG. 33 is a perspective view of a user utilizing the invention of FIG. 32, by pivotally adjusting the firearm to facilitate line of sight aiming via an iron sight, also known as an open sight, situated at a forty-five degree angle from the top mount of FIG. 32.

FIG. 33 illustrates the option of an iron or open sight comprising rear 168 and front 168' sights, respectively, which are mounted to the top rail 162 of the firearm and positioned to lie at a forty-five-degree angle therefrom on the outer side of the firearm 101. Alternatively, the sight could be mounted directly to the firearm at the forty-five-degree angle via a mount, rail or the like.

In the present example, referencing FIGS. 27-29 and 33, if the user U presently is aligned with the scope as shown in FIG. 32 and decides to utilize the iron or open site option, with the shoulder rest 140 in place, the firearm is pivoted 158 to dislodge spring 193 biased bearing 194 from the zero degree 203 groove 195 until it engages adjacent groove 199 at forty-five degrees 203', which engagement provides resistance to stabilize the firearm in that position while communicating to the user that the firearm's position is axially oriented so that the eye E of the user in alignment with the rear 168 and front 168 iron or open sights along the line of sight 157' aligned with the target T.

Figure 34:
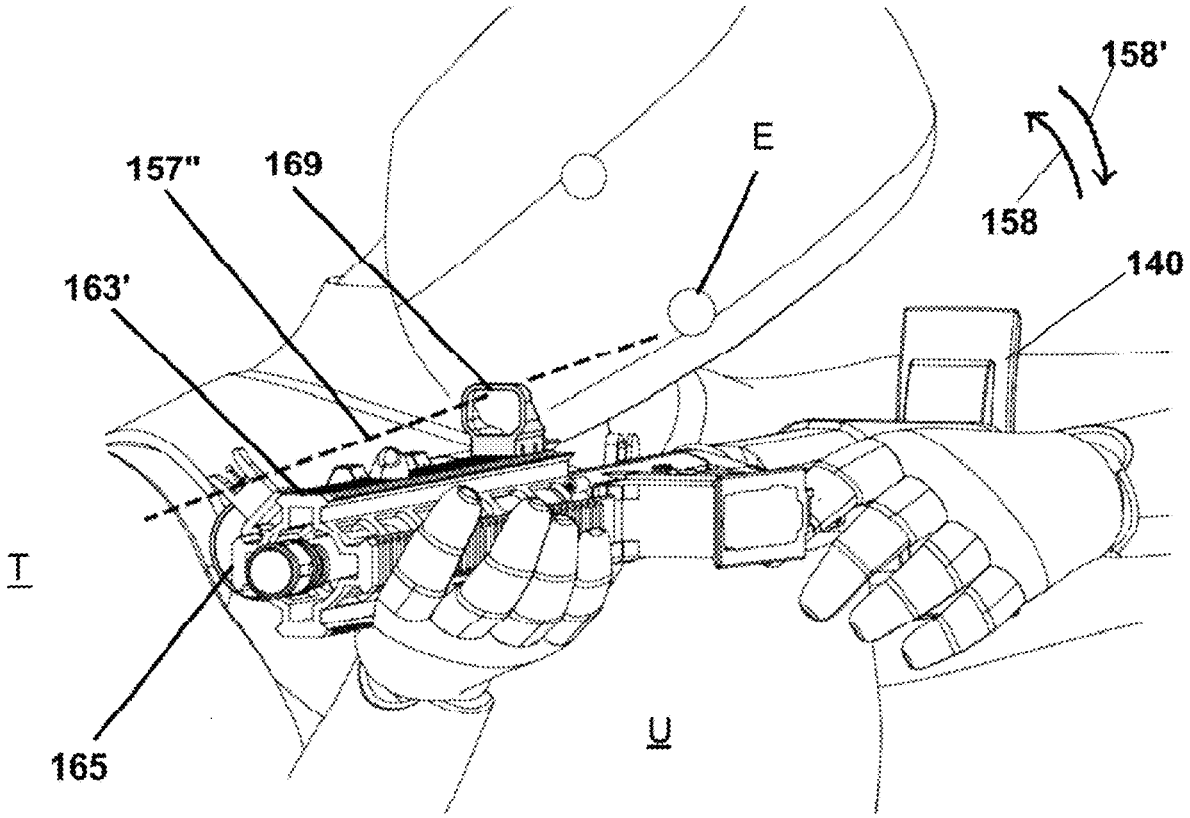
FIG. 34 is a perspective view illustrating a user utilizing invention of FIGS. 32-33, by pivotally adjusting the firearm to facilitate line of sight aiming via a reflex sight, situated at a ninety-degree angle relative to the top mount of FIG. 32.

FIG. 34 illustrates still another example or use, where the option of a reflex sight 169 is provided which is shown mounted to the outer side rail 163' of the firearm and as such is pivoted 158 to dislodge spring 193 biased bearing from the forty-five degree 203' groove 199 until it engages groove 199' at ninety degrees 203', which engagement provides resistance to further movement to stabilize the firearm in that position while communicating to the user that the firearm is axially positioned along at a forty-five degree angle relative to the position of the iron or open sites of FIG. 33, so that the user's U eye E is in line-of sight 157" alignment with reflex site 169 relative to the target T.

Figure 31:
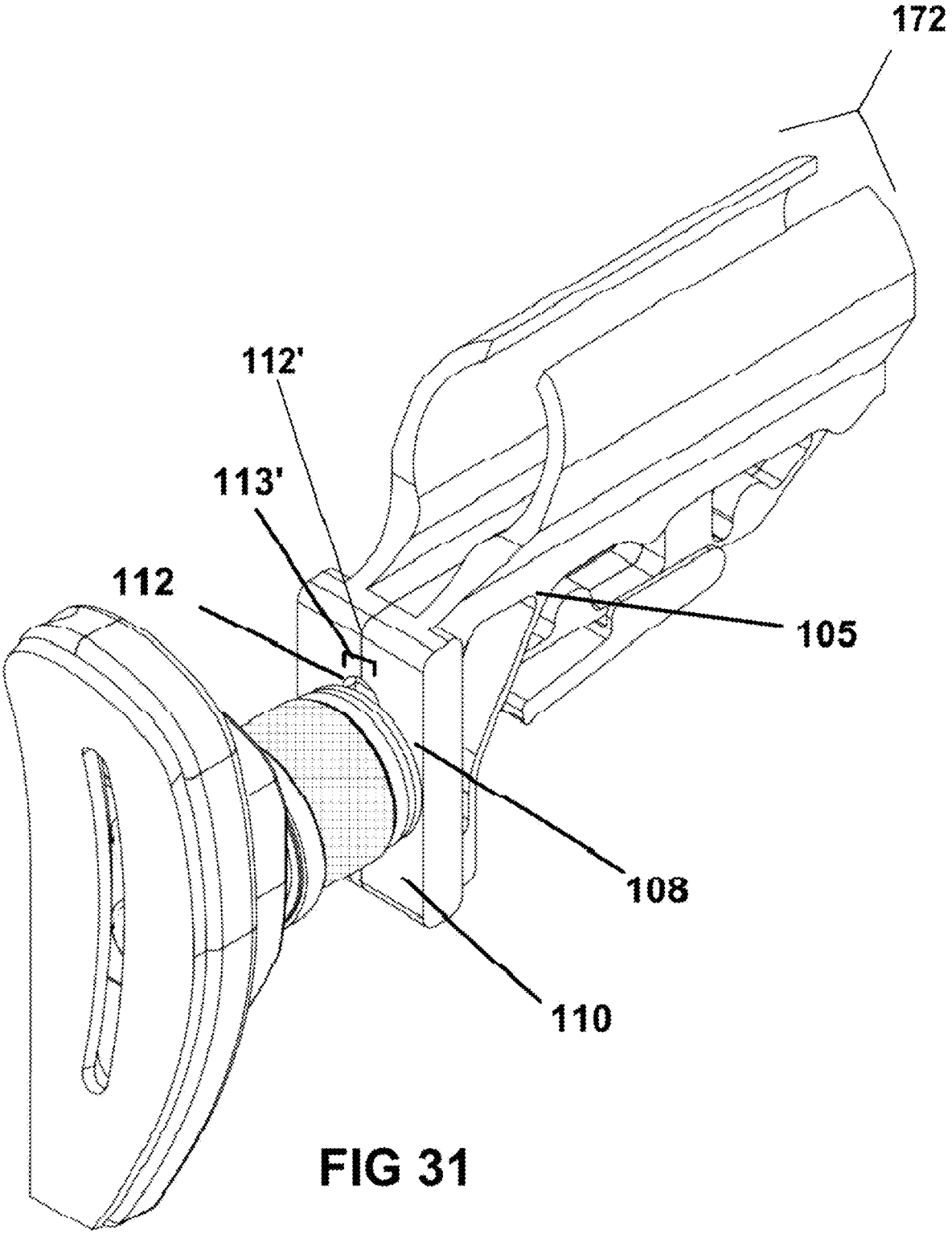
FIG. 31 is an upper, rear isometric view of the present invention.

FIG. 31 illustrates a cheek rest C which is adjustably mounted to the buttstock connector 130 via threaded fasteners or the like, and which is optional but can be effectively utilized by a user to further stabilize the firearm or gun during the target acquisition and aiming process.

It is further noted that, while grooves 195, 195', 195", 199, 199' are illustrated in the present example as radial lines emanating from a central point (i.e., center axis point 128), the grooves can be other configurations depending on the desired application, for example, concentric circles, indentations rather than lines, etc., which, in combination with specific placement relative to the bearing 194, would provide haptic feedback as to a desired orientation of the firearm or gun vs the shoulder rest.

Accordingly, the present invention allows a user the option of choosing from a variety of aiming options in real time by mounting an aiming option about the firearm as disclosed above, then utilizing the ball and socket connection earlier discussed to pivot and axially orient the firearm along its longitudinal axis to reposition the firearm to provide line-of-sight access to the desired aiming option by the user while in use, and utilize the biased ball bearing and groove arrangement as discussed above to provide haptic feedback regarding optimal orientations for sights mounted to the firearm, and when the firearm and shoulder rest are positioned at a predetermined orientation relative one another.

Based on the above, a summary of a method of use of the present invention could comprise, for example, the steps of:

a. providing a gun having rear stock having a butt plate,
- a pivot ball associated with said rear stock, said pivot ball having an outer diameter, said pivot ball further having a base formed to engage said butt plate;
- a shoulder rest formed to engage said rear stock via a socket having an inner wall engaging said pivot ball, so as to provide a swivel connection;
- a first sight mounted to said firearm along said longitudinal axis of said firearm;
- a second sight mounted to said firearm along said longitudinal axis of said firearm so that said second sight is pivotally spaced from said first sight;

b. providing a detent comprising a biased bearing in one of said ball or socket, and a first groove first and second detent components formed to releasably engage said ball and said socket so as to selectively limit swivel action between same, comprising the sub-step of positioning said first detent component along said outer diameter of said pivot ball and said second detent component along said inner wall of said socket so that their intersection and engagement are at a predetermined orientation of said gun and shoulder rest;

c. using said gun, comprising the sub-steps of:
- i. applying the shoulder rest of the gun to a shoulder of a user;
- ii. using said ball and socket to move relative one another in the form of swivel movement to position said gun for aiming at a target;
- iii. allowing said swivel movement to cause said first and second detent components to engage, providing resistance to further swivel movement between said ball and socket;

d. using said resistance to further swivel movement to provide feedback to the user to confirm said gun is at a predetermined orientation relative to said shoulder rest and one of said first or second sights to provide line-of-sight alignment with the user and said target.

It is noted that the exemplary detent feature of the present invention employing the spring-biased bearing emanating from the ball to engage the socket having grooves to receive the bearing is for illustrative purposes, and is not intended to be limiting, as other known detent mechanisms can likewise be employed depending on the application.

For example, instead of a spring biased ball bearing emanating from the ball (which could be referenced as first component of the detent mechanism), a spring-biased pin with rounded end emanating therefrom could be employed, and instead of a groove formed in the socket (which could be referenced as a second component of the detent mechanism), an indentation could be employed. Likewise, the spring-biased ball bearing could be alternatively made to emanate from a shaft formed in the socket, with the groove formed in the surface of the ball, instead of the illustrated example, which is visa-versa. Finally, instead of laterally emanating grooves emanating from a center axis, other groove or indentation configuration could likewise be employed, depending on the application.

ELEMENTS OF THE INVENTION

I Invention
T Extension Tube
S pocket of shoulder

U User
E Eye
L Longitudinal axis of firearm
C cheek rest
1 firearm
2 receiver
3,' first, second ends
4 barrel
5 stock
6,' first, second ends
7 tang
8 butt
9,' heel, toe
10,', ball-joint carrier, butt plate
11,',," first slot, length, opening
12,' second slot medially situated
13,' length, width
14 pivot ball retainer
15 threaded passage
16 ball joint
17,',," ball, nut/socket, top
18 neck
19 base
20,' threaded shaft, ball OD
21 nut
22 ID
23,' first, second open ends
24,' lip, slidingly envelope
25,' threaded area, taper
26,',," friction washer, OD
27,',," ID, first, second opposing open ends
28,', edge, taper
29 ball outer surface
30 adjustable buttstock connector
31,' first, second ends
32,' length, medial area
33,',," front, rear, radially curved
34,' first, second threaded passages
35 swivel extension
36,',," OD, threaded portion, length
37,' socket, inner wall formed to engage outer surface of top of ball
38 slidably adjustable
39,' tightened, loosened
40 shoulder rest
41 length
42,',," first side, second side, radius
43,' first, second ends
44,' first slot, opening
45 second slot aligned w/first
46 width
47 position lock plate
48,' width, length
49,' first, second passages
50 countersunk
51,' threaded fasteners
52,' loosening, tightening
53 sliding
54 wrench
55,' relief pad, slot
56 desired position
57 line of sight
58,' axial rotation
59,' pivot vertical
60,' pivot horizontal
61 tip
62, 62' upper/top lower bottom rails
63, 63' inner, outer side rails
64 ninety-degree position
65,' top, bottom of firearm
66,' inner, outer side of firearm
67 telescopic sight or scope
68,' iron or open site
69 reflex sight
101 firearm
102 receiver
103,' first, second ends
104 barrel
105 stock, halves 105', 105"
106,' first, second ends
107 tang
108 butt
109,' heel, toe
110 butt plate
111,',," first slot, length, opening
112,' second slot medially situated
113,' length, width
114 pivot ball position lock plate
115 threaded passage
116,' pivot ball, bearing shaft
117,',," ball, nut/socket, top
118,' neck, boss
119 base, flat
120,' threaded shaft, ball OD
121,' nut, adjustable swivel connection
122 ID
123,' first, second open ends
124,' lip, slidingly envelope
125,' threaded area, taper
126 friction washer
127 ID
128 center axis point
129,' ball outer surface, pivot ball shaft
130 buttstock connector
131,' first, second ends
132,' length, medial area
133,',," front, rear, radius
134,' first, second threaded passages
135 swivel extension
136,',," OD, threads, length
137,' socket, inner wall formed to engage outer surface of top of ball
138 slidably adjustable
139,' tightened, loosened
140,',," shoulder rest, first, second components
141 length
142,',," first side, second side, radius
143,' first, second ends
144,' first slot, opening
145 second slot aligned w/first
146 width
147 position lock plate
148,' width, length
149,' first, second passages
150 countersunk
151,' threaded fasteners
152,' loosening, tightening
153 sliding
154 wrench
155,' relief pad, slot
156 desired position
157,' line of sight
158,' axial rotation
159,' pivot vertical

160,' pivot horizontal
161 tip
162, 162' upper/top lower bottom rails
163, 163' inner, outer side rails
164 ninety-degree position
165,' top, bottom of firearm
166,' inner, outer side of firearm
167 telescopic sight or scope
168,' iron or open site
169 reflex sight
170,','' fasteners
171 passage
172,','' extension tube receiver, elements
173,' squeezing, releasing
174,','' adjustment pin, first, second ends
175 lever
176 spring
177 ID tube receiver
178, 178' pivot lever
179 stock position
180,' retract, urges
181 rotate
182,' first, second ends of ball 116
183 passage
184 ball pocket
185 threaded passage
186, fastener, threadingly engage
187,' upper, lower ends of stock
189 pass
190' first, second ends of grooves
191, insert, concave ID
192 lateral passage, depth width
193 helical spring, length
194,' ball bearing, OD
195,','' grooves
196,','' groove length, width, depth
197 groove radial wall
198,' groove edges
199,' grooves
200 outwardly biased
201,' shaft depth, ID
202,' Lock Nut, ID
203,','' zero, forty-five, ninety degrees The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

I claim:

1. A swivel connection for a gun, comprising:

a rear stock having first and second ends, a ball having an outer diameter, said ball situated on a base associated with said second end of said rear stock;

a shoulder rest having a socket formed to engage said rear stock via said ball;

a detent for releasably engaging said ball and said socket;

wherein said ball and socket provide between said gun and said shoulder rest a swivel connection and said detent is formed to selectively limit said swivel connection so as to provide feedback to a user; and whereby said detent comprises first and second components situated along said ball and socket, respectively, such that their intersection and engagement are at a predetermined orientation of said gun and said shoulder rest, and said feedback confirms to a user said predetermined orientation.

2. The apparatus of claim 1, wherein said first component of said detent comprises a spring-biased bearing.

3. The apparatus of claim 2, wherein said spring-biased bearing is situated in a shaft in said ball such that said spring urges said bearing from said shaft.

4. The apparatus of claim 3, wherein said second component of said detent comprises a first groove radially situated along said socket, said groove formed to engage said spring-biased bearing.

5. The apparatus of claim 4, wherein said shoulder rest has a length, and wherein said first groove is radially situated along said socket in alignment with said length, and wherein said ball has an outer surface having emanating therefrom a bearing formed to engage said first groove when said ball is positioned so that said bearing is over said first groove.

6. The apparatus of claim 5, wherein said bearing is spring-biased via a helical spring situated in said shaft formed in said ball.

7. The apparatus of claim 6, wherein said bearing engaging said first groove provides resistance to movement between said ball and said socket.

8. The apparatus of claim 7, wherein said gun has situated thereon a top mount with a first sighting apparatus mounted thereto, and wherein said first and second components of said detent are positioned along said ball and socket, respectively, to engage to communicate to a user of said gun line-of-sight alignment to a target via said first sighting apparatus.

9. The apparatus of claim 8, wherein said gun has situated thereon second and third, opposing side mounts with a second and third sighting apparatus mounted thereto, respectively, said second and third side mounts situated at opposing ninety-degree angles from said first sighting apparatus, and wherein said first and second components of said detent are positioned along said ball and socket, respectively, to engage to communicate line-of-sight alignment to a target for a user of said gun via said second and third sighting apparatus, respectively.

10. The apparatus of claim 8, wherein said gun has situated thereon a second sighting apparatus situated at forty-five degrees relative to said first sighting apparatus, and wherein said first and second components of said detent are positioned along said ball and socket, respectively, to engage to communicate line-of-sight alignment to a target for a user of said gun via said second sighting apparatus.

11. The apparatus of claim 7, wherein said shoulder rest has a length, and wherein said first groove is situated along a radial line of said socket, said first groove having a length in alignment with said length of said shoulder rest.

12. The apparatus of claim 7, wherein said first groove is positioned relative to said shoulder rest, and said bearing is positioned relative to said rear stock of said gun, so that positioning said bearing to engage said first groove aligns said gun to a predetermined alignment relative to said shoulder rest.

13. The apparatus of claim 1, wherein said gun has a first sighting apparatus mounted thereto, and wherein said first and second components of said detent are positioned along said ball and socket, respectively, to engage to communicate to a user of said gun line-of-sight alignment to a target via said first sighting apparatus.

14. The apparatus of claim 13, wherein said gun has opposing first and second sides having mounted thereto second and third sighting apparatus, respectively, respectively, said second and third side mounts situated at opposing ninety-degree angles from said first sighting apparatus, and wherein said first and second components of said detent are positioned along said ball and socket, respectively, to engage to communicate line-of-sight alignment to a target for a user of said gun via said second and third sighting apparatus, respectively.

15. The apparatus of claim 13, wherein said gun has situated thereon a second sighting apparatus situated at forty-five degrees relative to said first sighting apparatus, and wherein said first and second components of said detent are positioned along said ball and socket, respectively, to engage to line-of-sight alignment to a target for a user of said gun via said second sighting apparatus.

16. A method of utilizing a gun having a longitudinal axis, comprising the steps of:

a. providing a gun having rear stock having a butt plate,
  a pivot ball associated with said rear stock, said pivot ball having an outer diameter, said pivot ball further having a base formed to engage said butt plate;
  a shoulder rest formed to engage said rear stock via a socket having an inner wall engaging said pivot ball, so as to provide a swivel connection;

b. providing a detent comprising first and second detent components formed to releasably engage said ball and said socket so as to selectively limit swivel action between same, comprising the sub-step of positioning said first detent component along said outer diameter of said pivot ball and said second detent component along said inner wall of said socket so that their intersection and engagement are at a predetermined orientation of said gun and shoulder rest;

c. using said gun, comprising the sub-steps of:

i. applying the shoulder rest of the gun to a shoulder of a user;

ii. using the ball and socket to move relative one another in the form of a swivel movement to position the gun for aiming at a target;

iii. allowing said swivel movement to cause the first and second detent components to intersect to engage, providing resistance to further swivel movement between said ball and socket;

d. using said resistance to further swivel movement to provide feedback to the user to confirm said gun is at a predetermined orientation relative to said shoulder rest and that a sight on said gun to provide line-of-sight alignment with the user and said target.

17. A method of utilizing a gun having a longitudinal axis, comprising the steps of:

a. providing a gun having rear stock having a butt plate,
  a pivot ball associated with said rear stock, said pivot ball having an outer diameter, said pivot ball further having a base formed to engage said butt plate;
  a shoulder rest formed to engage said rear stock via a socket having an inner wall engaging said pivot ball, so as to provide a swivel connection;
  a first sight mounted to said firearm along said longitudinal axis of said firearm;
  a second sight mounted to said firearm along said longitudinal axis of said firearm so that said second sight is pivotally spaced from said first sight;

b. providing a detent comprising a biased bearing in one of said ball or socket, and first and second detent components formed to releasably engage said ball and said socket so as to selectively limit swivel action between same, comprising the sub-step of positioning said first detent component along said outer diameter of said pivot ball and said second detent component along said inner wall of said socket so that their intersection and engagement are at a predetermined orientation of said gun and shoulder rest;

c. using said gun, comprising the sub-steps of:

i. applying the shoulder rest of the gun to a shoulder of a user;

ii. using said ball and socket to move relative one another in the form of swivel movement to position said gun for aiming at a target;

iii. allowing said swivel movement to cause said first and second detent components to engage, providing resistance to further swivel movement between said ball and socket;

d. using said resistance to further swivel movement to provide feedback to the user to confirm said gun is at a predetermined orientation relative to said shoulder rest and one of said first or second sights to provide line-of-sight alignment with the user and said target.

18. The method of claim 17, wherein in step "c" said user pivots said firearm to utilize one of said first or second sights to aim said firearm at said first target.

19. The method of claim 17, wherein in step "d" there is provided the further step:

d1. pivoting the firearm from one of said first or second sights to the other sight to aim said firearm at a second target.

20. The method of claim 18, wherein said second sight is mounted at a forty-five-degree angle relative to said first sight.

21. The method of claim 18, wherein said second sight is mounted at a ninety-degree angle relative to said first sight.

* * * * *